US006233893B1

(12) United States Patent
Lewis

(10) Patent No.: US 6,233,893 B1
(45) Date of Patent: May 22, 2001

(54) CORE ASSEMBLY AND METHOD FOR MAKING SAME

(76) Inventor: J. Harry Lewis, 252 Hamilton Crescent, Dorchester, Ontario (CA), N0L 1G1

( * ) Notice: Subject to any disclaimer, the term of this patent is extended or adjusted under 35 U.S.C. 154(b) by 0 days.

(21) Appl. No.: 09/501,141

(22) Filed: Feb. 9, 2000

(51) Int. Cl.[7] ..... E04B 1/74

(52) U.S. Cl. ..... 52/405.3; 52/344; 52/318; 52/667; 52/745.19

(58) Field of Search ..... 52/405.3, 344, 52/348, 333, 340, 341, 414, 764, 763, 745.19, 579, 582.2, 583.1, 586.1, 637, 667, 668

(56) References Cited

U.S. PATENT DOCUMENTS 2,053,135 * 9/1936 Dalton ..... 52/318
5,595,034 * 1/1997 Krysalka et al. ..... 52/318

FOREIGN PATENT DOCUMENTS 2189225 1/1998 (CA) .

* cited by examiner

*Primary Examiner*—Carl D. Friedman
*Assistant Examiner*—Naoko Slack
(74) *Attorney, Agent, or Firm*—R. Craig Armstrong

(57) ABSTRACT

A substantially rectangular reinforcement assembly for concrete castings, having a longitudinal axis and a transverse axis. The assembly comprises a frame, a first set of longitudinal runners, a second set of transverse runners, and a third set of transverse runners. Each individual runner has two short ends, and each short end has a frame holding means. The runners are arranged in a hatch pattern, where the longitudinal runners are arranged substantially perpendicular to the transverse runners. The frame comprises a first leg member, a second leg member, and a shoulder member. The first leg member has a plurality of through holes and the second leg member has a corresponding number of through holes, which are substantially concentric with the corresponding through holes of the first leg member. Runner end mounting means are arranged in a pair of corresponding through holes of the first and second leg members, respectively, and the frame holding means of each short end of a runner is arranged to engage with an individual runner end mounting means of the frame.

20 Claims, 21 Drawing Sheets

CORE ASSEMBLY AND METHOD FOR MAKING SAME

BACKGROUND OF THE INVENTION

1. Field of the Invention

This invention relates to reinforcing core assemblies for forming barriers, especially for use as reinforcement in concrete castings.

2. Description of the Prior Art

Reinforcement assemblies for concrete castings comprising a substantially rectangular frame and crossing runners are disclosed in, for example, CA 2,189,225 (McReynolds). The assembly comprises a first set of runners positioned in the longitudinal direction of the frame and a second set of runners positioned transversely to the longitudinal direction of the frame. The two sets of runners are assembled to form a hatch pattern of runners, using shaped notches arranged in the runners, to accommodate the profile of one runner into a perpendicular runner. The longitudinal runners thus mesh with the corresponding transverse runners. The frame is then put over the runner assembly onto frame notches located at the short ends of the respective runners. A third set of runners, positioned in the longitudinal direction of the frame, is then placed between the individual runners of the first set of runners positioned in the longitudinal direction of the frame, and meshing with the transverse runners. Thereafter, the second set of transverse runners are tilted sideways, so that all longitudinal runners are temporarily interlocked with the transverse runners and a semi-rigid assembly is created, a fourth set of transverse runners is installed and the runners of the fourth set are tilted into their interlocking positions, where they lock the assembly to prevent the removal of any individual runner from the assembly.

Reinforcement assemblies for concrete castings of the type described above generally require a relatively complex frame construction to provide the gripping profile needed for the runners to hold on to the frame. This results in a frame that is unnecessarily complicated and, thus, unnecessarily expensive to manufacture.

SUMMARY OF THE INVENTION

It is an object of the invention to mitigate and/or obviate the above mentioned disadvantages to provide a reinforcement assembly for concrete castings, which is easy and cheap to manufacture and assemble and which provides the required gripping means for the individual runners to provide an enhanced strength for the reinforcement assembly both during assembly and during the actual use of the finished barrier.

In the invention, a substantially rectangular reinforcement assembly for concrete castings is disclosed. The assembly has a longitudinal axis and a transverse axis, and comprises a frame, a first set of longitudinal runners, a second set of transverse runners, and a third set of transverse runners. Each individual runner has two short ends, and each short end has a frame holding means. The runners are arranged in a hatch pattern, where the longitudinal runners are arranged substantially perpendicular to the transverse runners. The first set of longitudinal runners, the second set of transverse runners and the third set of transverse runners are preferably substantially flat.

The frame comprises a first leg member, a second leg member, and a shoulder member. The first leg member has a plurality of through holes, and the second leg member has a corresponding number of through holes which are substantially concentric with the corresponding through holes of the first leg member. Runner end mounting means are arranged in a pair of corresponding through holes of the first and second leg members, respectively, and the frame holding means of each short end of a runner is arranged to engage with an individual runner end mounting means of the frame.

Advantageously, the frame comprises four separate parts, a first longitudinal part and a second longitudinal part together with a first transversal part and a second transversal part.

The reinforcement assembly for concrete castings further advantageously comprises strengthening members, which are longitudinally arranged between the first and second sets of transverse runners to further strengthen the assembly. The strengthening members preferably comprise bars having a cross-sectional shape corresponding to the shape of holes or notches in the first and second transverse runners, respectively.

In one embodiment of the invention, the first leg member, the second leg member and the shoulder member are arranged in a substantially U-shaped cross-section.

In an alternative embodiment of the invention, the first leg member, the second leg member and the shoulder member are arranged in a substantially H-shaped cross-section.

In a further alternative embodiment of the invention, the first leg member, the second leg member, the shoulder member and a closure member are arranged in a substantially closed cross-section, i.e. forming a substantially rectangular cross-section.

Several of the reinforcement assemblies may be interconnected, either before or after casting, to form larger barrier systems, such as walls or floors/ceilings of a building.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which:

FIG. 5I is an elevational perspective side view of a second set of transverse runners laid out on the assembly of FIG. 5H for step four of a step-by-step assembly of a reinforcement assembly according to the second embodiment of invention.

DETAILED DESCRIPTION OF THE PREFERRED EMBODIMENT

The reinforcement assemblies of the invention are preferably used to form reinforced concrete building panels by placing the reinforcement assembly in a mould and pouring concrete into the mould. After the concrete has set, the building panel may be joined to other panels (as will be described later), or used by itself.

Figure 1A:
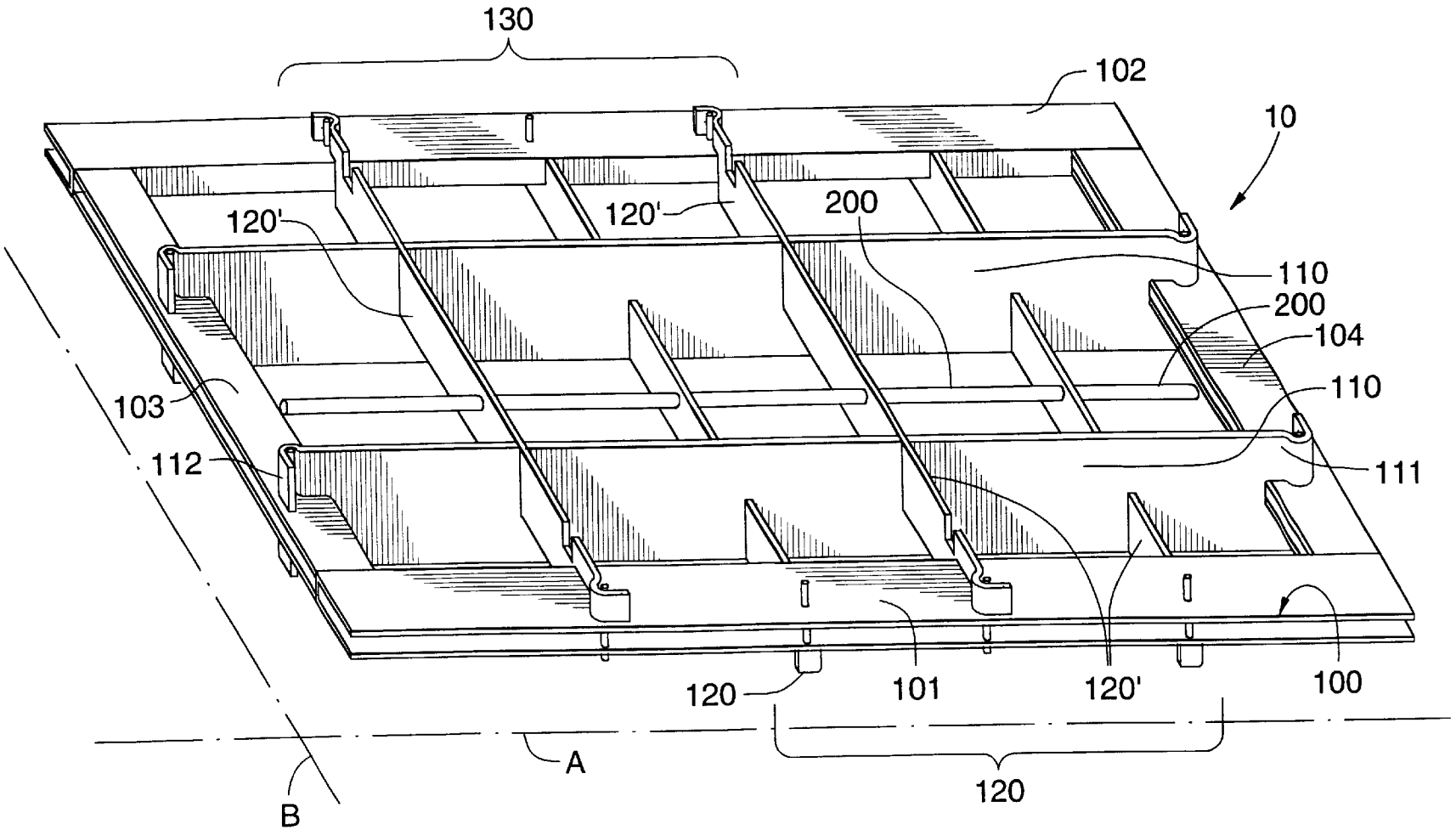
FIG. 1A is a schematic elevational perspective side view of a first embodiment of a reinforcement assembly according to the invention.

Referring to FIG. 1A, a reinforcement assembly 10 for concrete castings according to a first embodiment of the invention is shown, where the assembly has a substantially rectangular shape having a longitudinal axis A and a transverse axis B. The assembly comprises a frame 100, a plurality of longitudinal runners 110, a first set 120 of transverse runners 120', and a second set 130 of transverse runners 120'. The frame preferably includes four separate parts, a first longitudinal part 101 and a second longitudinal part 102 together with a first transversal part 103 and a second transversal part 104. The runners are arranged in a hatch pattern where the longitudinal runners are arranged substantially perpendicular to the transverse runners.

Figure 2A:
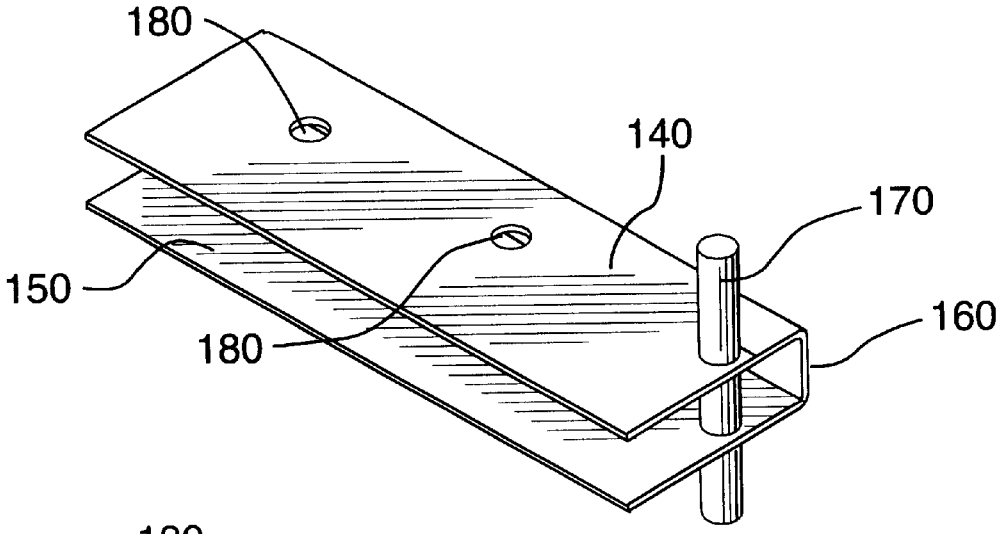
FIG. 2A is a schematic elevational perspective side view of a frame part according to the first or second embodiments of the invention.
Figure 2B:
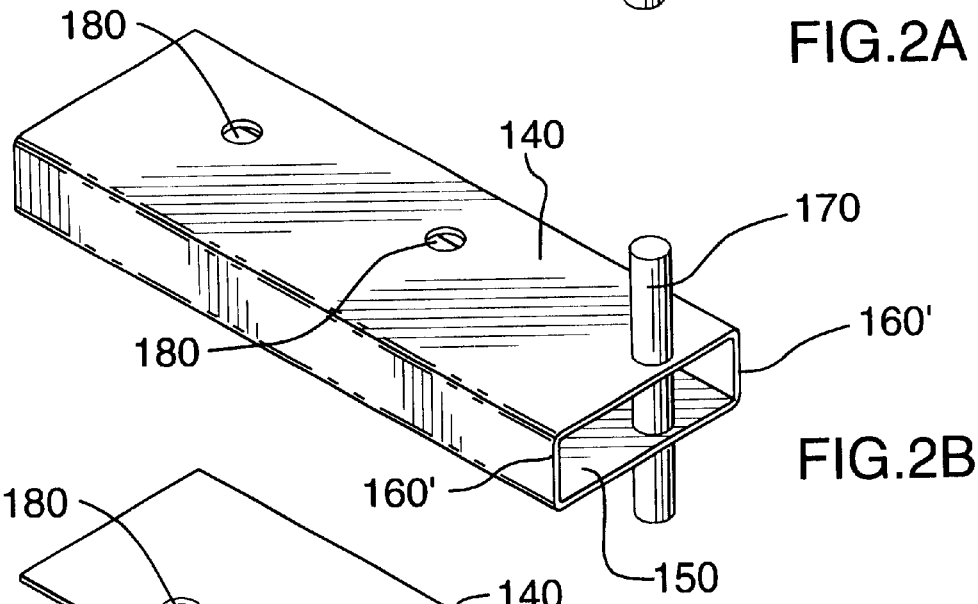
FIG. 2B is a schematic elevational perspective side view of a frame part according to a third embodiment of the invention.
Figure 2C:
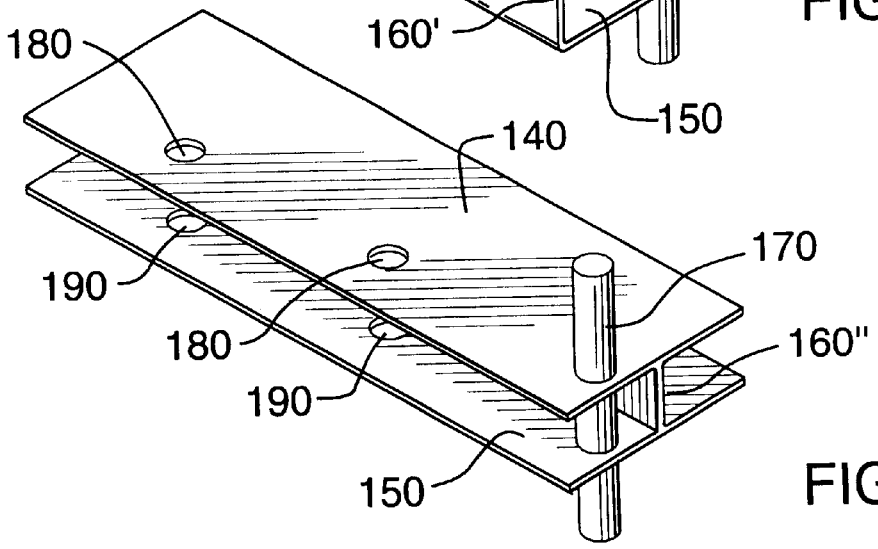
FIG. 2C is a schematic elevational perspective side view of a frame part according to a fourth embodiment of the invention.

Each of the first and second longitudinal parts and the first and second transversal parts of the frame preferably comprise a first leg member 140, a second leg member 150, and a first shoulder member 160, as is shown in FIG. 2A The first leg member has a plurality of first through holes 180 and the second leg member has a corresponding number of second through holes 190, which are substantially concentric with the corresponding first through holes of the first leg member. Runner end mounting means 170 are arranged in a pair of corresponding first and second through holes of the first and second leg members, respectively, and the frame holding means of each short end of a runner are arranged to engage with an individual runner end mounting means of the frame. The runner end mounting means are preferably shaped as substantially cylindrical rods, optionally having a sharpened or rounded end for insertion into appropriate cutout openings on the frame parts, and a flattened head for facilitating the application of a driving force onto the head. The number of runner end mounting means 170 corresponds to the desired number of runner ends to fasten onto the frame parts. Preferably, the runner end mounting means comprise rods of substantially round cross-section, which may be inserted into and fixedly mounted in the first through holes 180 of the first leg member 140 and the second through holes 190 of the second leg member 150. The rods may be welded to the frame or fastened in any other known way. Alternative embodiments of frame leg members are shown in FIGS. 2B and 2C. The same reference numerals have been used for the same technical features, as in FIG. 2A. In FIG. 2B, a second embodiment is shown, having a substantially rectangular cross-section. The first leg member 140 and the second leg member 150 are connected via two second shoulder members 160' at each long end of the frame, thus forming the substantially rectangular cross-section. In FIG. 2C, a third embodiment is shown, having a substantially H-shaped cross-section. The first leg member 140 and the second leg member 150 are connected via a third shoulder member 160" arranged longitudinally and substantially in the middle of the first leg member and the second leg member, thus forming the substantially rectangular cross-section.

Figures 3A, 3B:
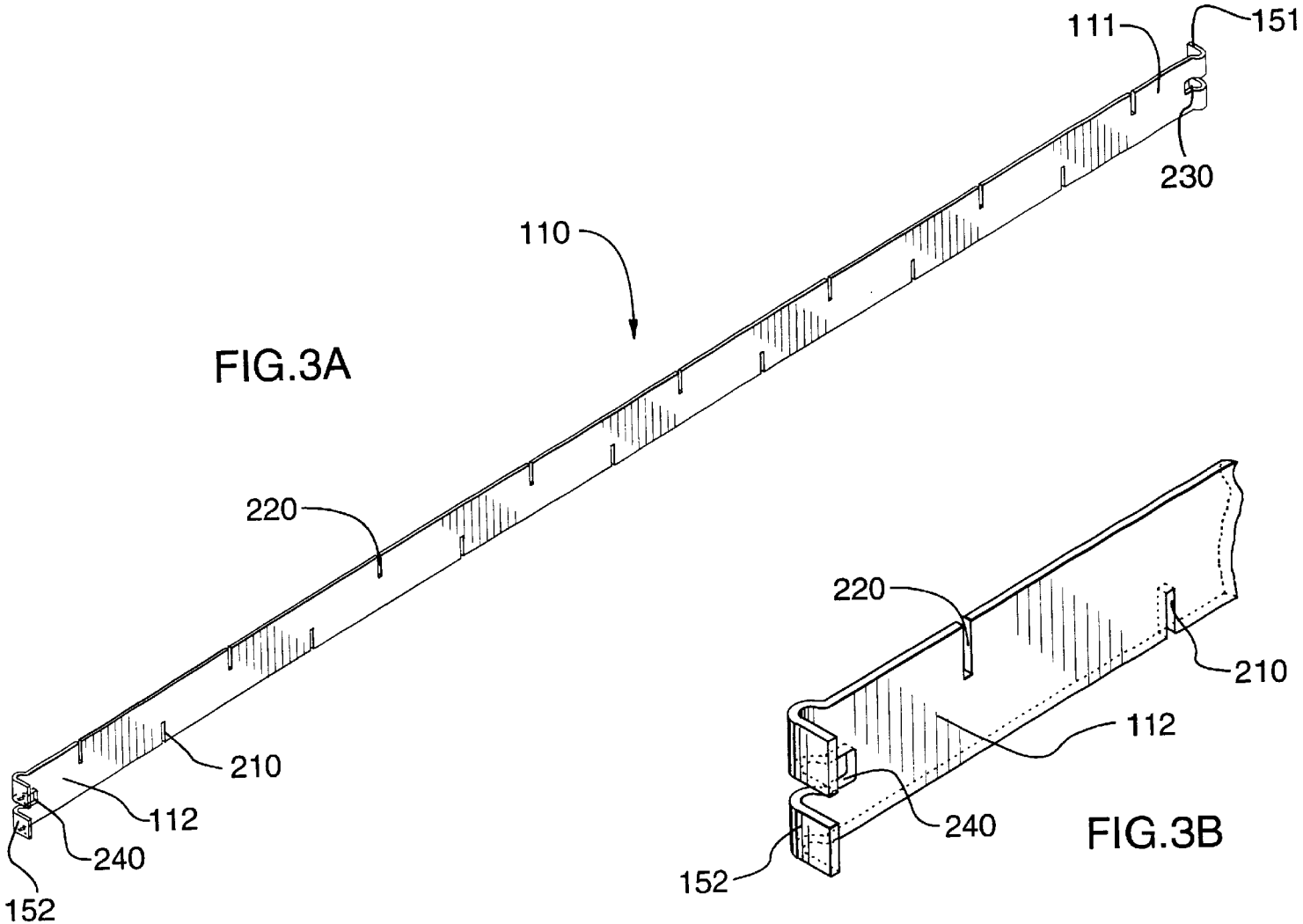
FIG. 3A is an elevational perspective side view of a longitudinal runner according to the first embodiment of the invention.
FIG. 3B is an elevational perspective side view of a part of a longitudinal runner according to FIG. 3A.

As is shown in FIGS. 3A and 3B, each longitudinal runner 110 preferably has an oblong substantially flat shape having a first short end 111 and a second short end 112. The first short end has a first frame holding means 151 and a first cutout 230 for accommodating at least part of the frame profile, and the second short end has a second frame holding means 152 and a second cutout 240, also for accommodating at least part of the frame profile. The first frame holding means 151 and the second frame holding means 152 are preferably hook-shaped or comprise right angle bends, with the hooks preferably facing opposite directions as shown in FIG. 3A. Opposing hooks facilitate stacking of the runners during storage. Alternatively, both hooks are facing the same direction (not shown). The frame holding means being hook-shaped allows each frame holding means to be engageable around at least part of the circumference of the runner end mounting means 170. The longitudinal runners 110 further have third cutouts 210 arranged along a first long end of the runner and fourth cutouts 220 arranged along the opposite second long end of the runner. The third and fourth cutouts, 210, 220 respectively, cooperate with transversal runners when the reinforcing assembly is in an assembled state, and are shaped as simple slots in the first embodiment allowing the transversal runners to easily be dropped or inserted into position. In FIG. 3A, the runner 110 of the first set is shown as having two each of the third and fourth cutouts, 210, 220 respectively, but any desirable number of cutouts may be used, corresponding to the desired number of transverse runners used.

Figure 4A:
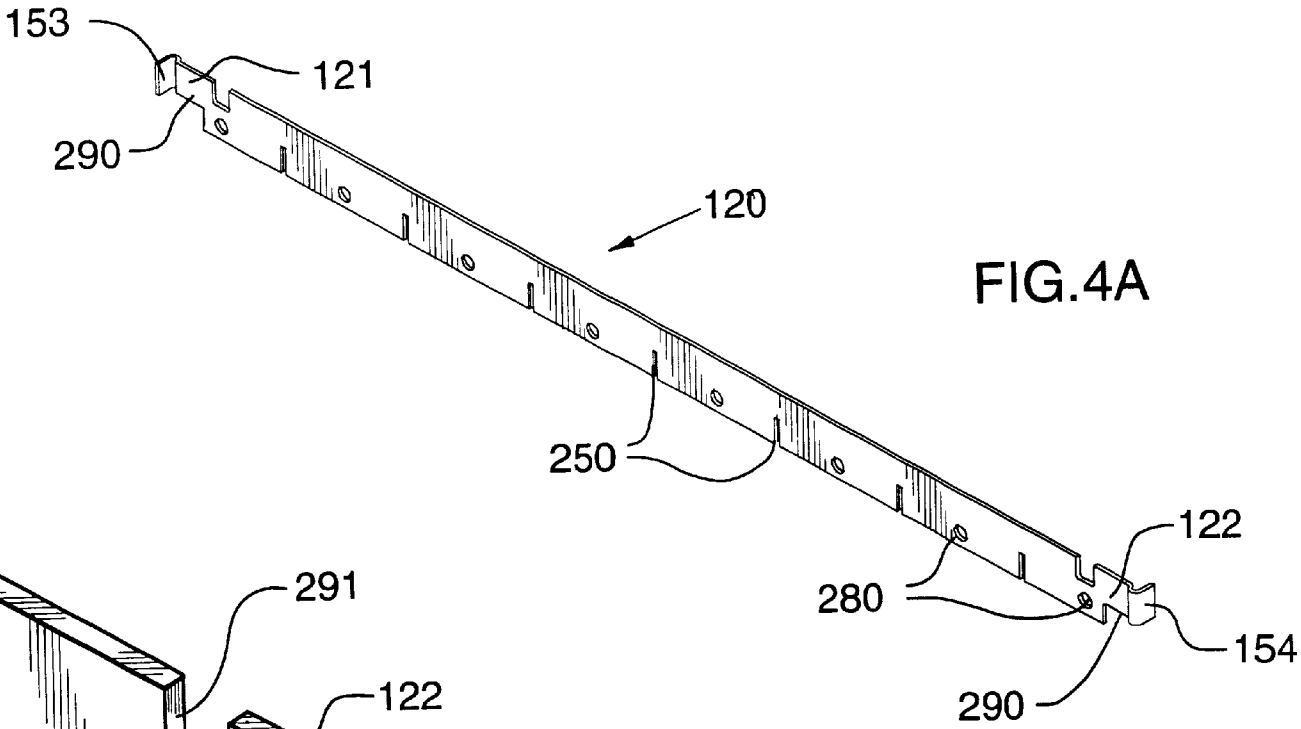
FIG. 4A is an elevational perspective side view of a transversal runner according to the first embodiment of the invention.
Figure 4B:
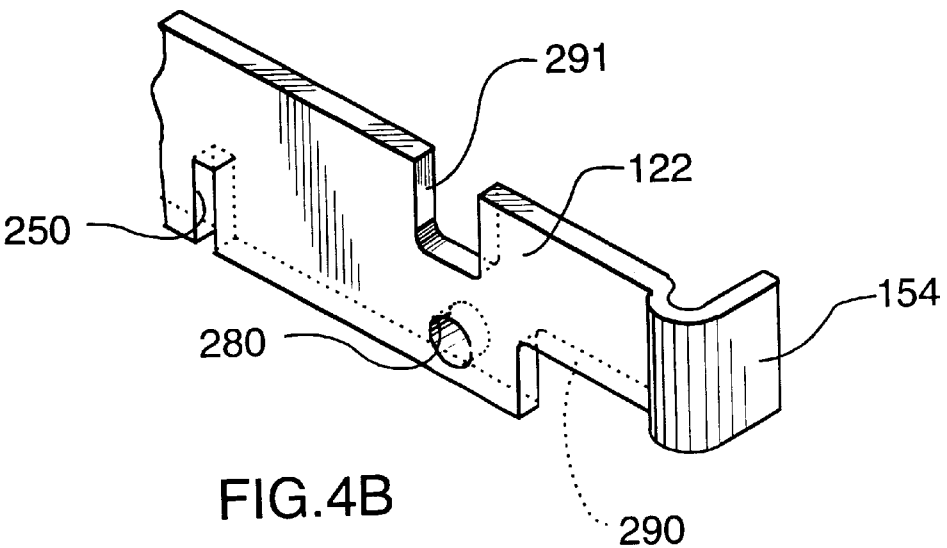
FIG. 4B is an elevational perspective side view of a part of a transversal runner according to FIG. 4A.
Figure 6A:
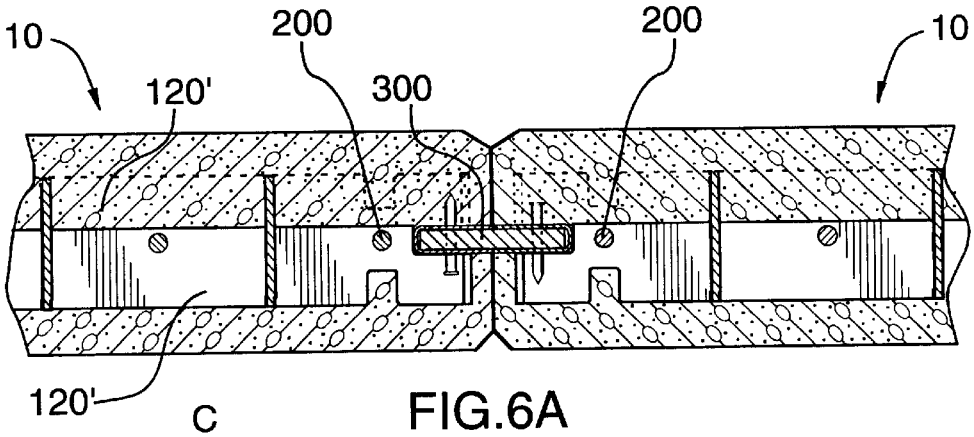
FIG. 6A is a schematic side view of an end-to-end joint of two reinforcement assemblies according to the first embodiment of the invention.
Figure 6B:
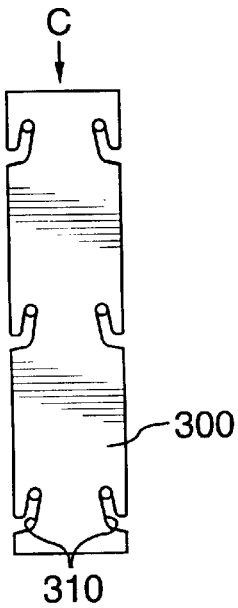
FIG. 6B is a schematic elevational perspective view of a key section used to connect two reinforcement assemblies according to the invention.

As is shown in FIGS. 4A and 4B, each transverse runner of the first and second set preferably has an oblong substantially flat shape having a third short end 121 and a fourth short end 122. There is no structural difference between transverse runners of the first set and transverse runners of the second set. The third short end 121 has a third frame holding means 153 to securely grip the frame 100. The fourth short end 122 has a fourth frame holding means 154, also to securely grip the frame. Further, fifth cutouts 250 are arranged along one long side of each transversal runner, to cooperate with the third cutouts 210 or the fourth cutouts 220 of the longitudinal runners, when the reinforcing assembly 10 is in an assembled state. The transverse runners 120' further have seventh cutouts 290, arranged at each of the third short end 121 and the fourth short end 122, for accommodating at least a part of the frame profile. Ninth cutouts 291 are arranged towards each end of the transverse runners 120'. As shown in FIG. 6C, the ninth cutouts are used to connect two reinforcement assemblies 10 forming a 90 degree corner joint. See further the description below relating to FIGS. 6A to 6D.

The reinforcement assembly 10 for concrete castings further comprises locking and strengthening members 200, which are longitudinally arranged between the first and second sets of transverse runners to further strengthen the assembly. The locking and strengthening members preferably comprise bars having a cross-sectional shape corresponding to the shape of cutouts in the first and second transverse runners, respectively. The transverse runners 120' preferably comprise eighth cutouts 280, in the shape of holes having a cross-section corresponding to the cross-section of the locking and strengthening members 200, to accommodate the locking and strengthening members. To facilitate the insertion of the locking and strengthening members into the eighth cutouts 280, the ends of the locking and strengthening members are preferably substantially conical or hemispherical, so called bullet ends.

Figure 1B:
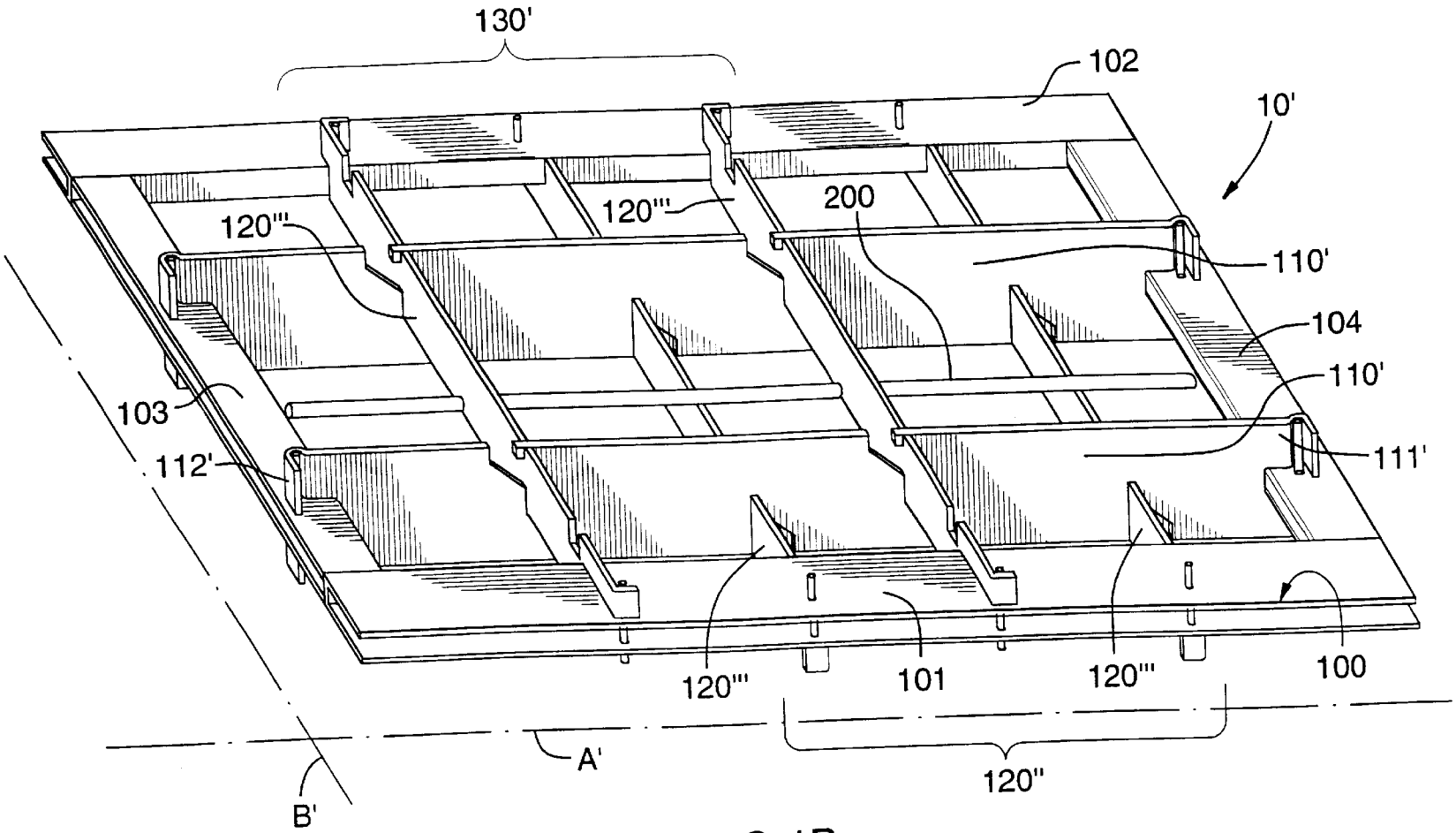
FIG. 1B is a schematic elevational perspective side view of a second embodiment of a reinforcement assembly according to the invention.

Referring to FIG. 1B, a second embodiment of the invention includes a reinforcement assembly 10' for concrete castings, where the assembly has a substantially rectangular shape having a longitudinal axis A' and a transverse axis B'. The assembly comprises the same frame 100 as shown in FIG. 1A, a plurality of longitudinal runners 110', a first set 120" of transverse runners 120'", and a second set 130' of transverse runners 120'". The runners are arranged in a hatch pattern where the longitudinal runners are arranged substantially perpendicular to the transverse runners. The reference numerals for the frame are the same as those used in FIG. 1A. The frame is also the same as described in connection with FIGS. 2A to 2C.

Figures 3C, 3D:
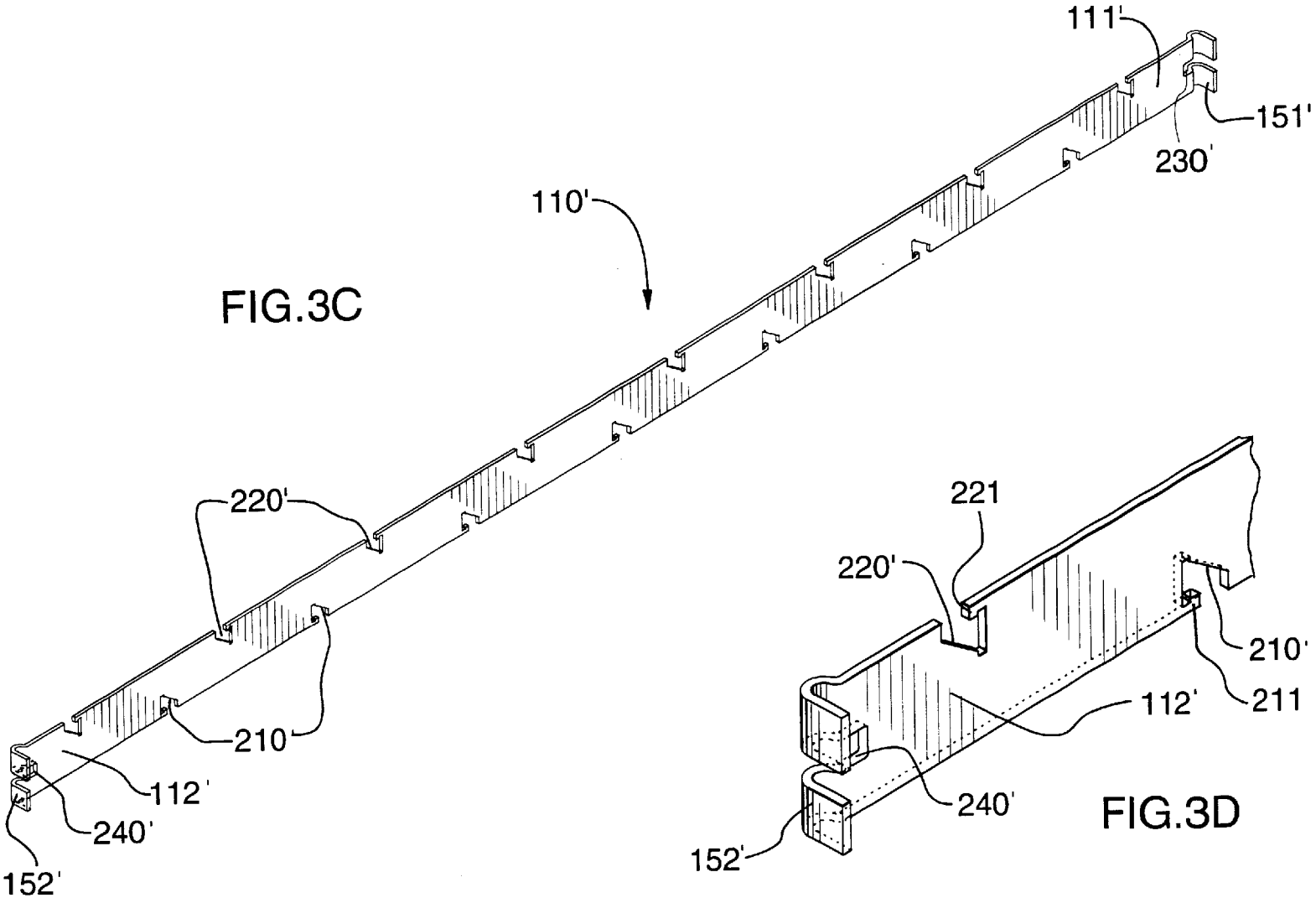
FIG. 3C is an elevational perspective side view of a longitudinal runner according to the second embodiment of the invention.
FIG. 3D is an elevational perspective side view of a part of a longitudinal runner according to FIG. 3C.

As is shown in FIGS. 3C and 3D, each longitudinal runner 110' preferably has an oblong substantially flat shape having a first short end 111' and a second short end 112'. The first short end has a first frame holding means 151' and a first cutout 230' for accommodating at least part of the frame profile, and the second short end has a second frame holding means 152' and a second cutout 240', also for accommodating at least part of the frame profile. The longitudinal runners 110' further have tenth cutouts 210' arranged along a first long end of the runner and eleventh cutouts 220' arranged along the opposite second long end of the runner. The tenth and eleventh cutouts, 210', 220' respectively, cooperate with transversal runners when the reinforcing assembly is in an assembled state, and are substantially triangularly shaped, with a runner holding protrusion 211 and 221, respectively. The transversal runners are inserted at an angle into the tenth and eleventh cutouts, 210', 220' respectively, contacting the angled side of the cutouts. The runners are thereafter raised to a standing position, where they are held in the tenth and eleventh cutouts, 210', 220' respectively, by the runner holding protrusions 211, 221. The first frame holding means 151' and the second frame holding means 152' are preferably hook-shaped or comprise right angle bends and will, in the second embodiment, have to point the same direction, otherwise one of the frame holding means will interfere with the raising rotation of the transversal runner. In FIG. 3A, the runner 110' of the first set is shown as having two each of the tenth and eleventh cutouts, 210', 220' respectively, but any desirable number of cutouts may be used, corresponding to the desired number of transverse runners used.

Figure 4C:
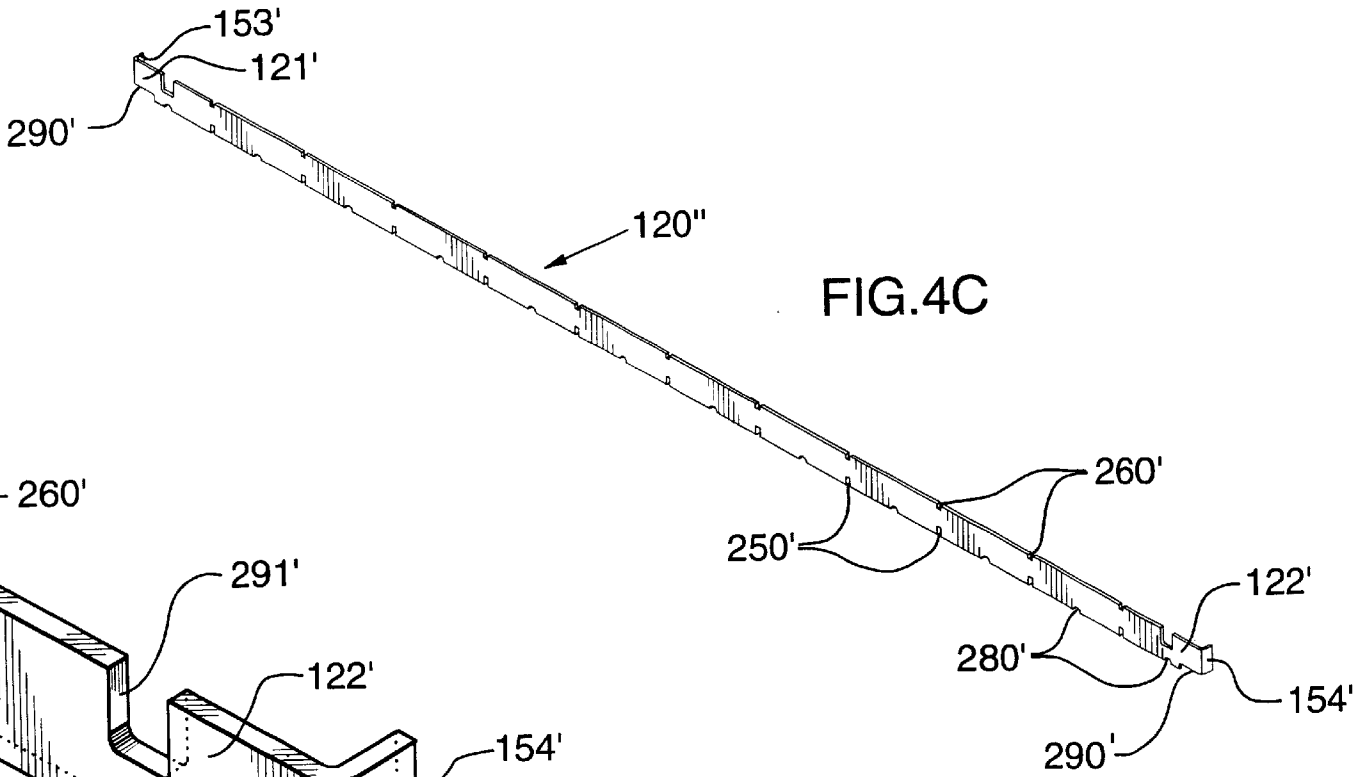
FIG. 4C is an elevational perspective side view of a transversal runner according to the second embodiment of the invention.
Figure 4D:
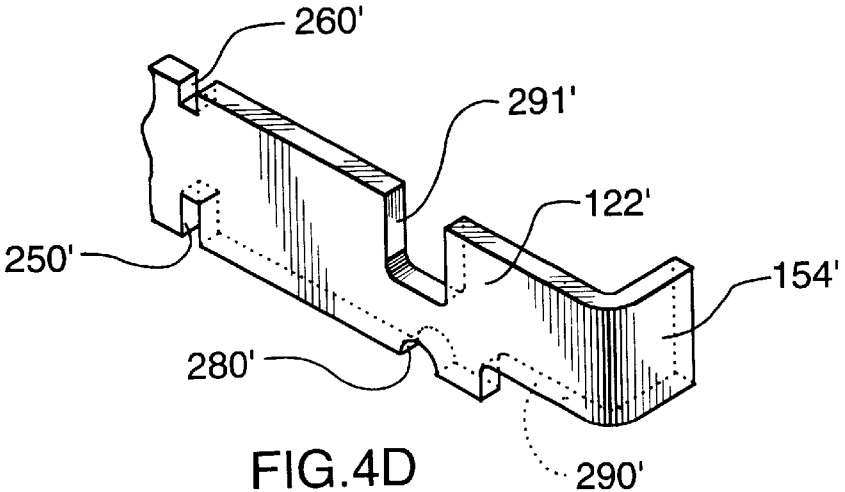
FIG. 4D is an elevational perspective side view of a part of a transversal runner according to FIG. 4C.

As is shown in FIGS. 4C and 4D, each transverse runner of the first and second set preferably has an oblong substantially flat shape having a third short end 121' and a fourth short end 122'. There is no structural difference between transverse runners of the first set and transverse runners of the second set. The third short end 121' has a third frame holding means 153' to securely grip the frame 100. The fourth short end 122' has a fourth frame holding means 154', also to securely grip the frame. Further, fifth cutouts 250' and sixth cutouts 260' are arranged on opposite long ends of each transversal runner, to cooperate with the tenth cutouts 210 or the eleventh cutouts 220 of the longitudinal runners, when the reinforcing assembly 10' is in an assembled state. The transverse runners 120'" further have seventh cutouts 290', arranged at each of the third short end 121' and the fourth short end 122', for accommodating at least a part of the frame profile. Ninth cutouts 291' are arranged towards each end of the transverse runners 120'". The ninth cutouts are used to connect two reinforcement assemblies 10' forming a 90 degree corner joint. See further the description below relating to FIGS. 6A to 6D.

The locking and strengthening members 200, which are longitudinally arranged between the first and second sets of transverse runners are accommodated in eighth cutouts 280', having a semi-circular cross-section corresponding to one half of the cross-section of the locking and strengthening members 200. The locking and strengthening members 200 are thus clamped in place by alternating transverse runners of the first and second set, as opposed to the first embodiment of the invention. A certain spring action is thus created by the alternating transverse runners pressing the locking and strengthening members 200, and this spring action helps keep the assembly together until concrete has been poured to form a reinforced concrete building panel.

Figure 5A:
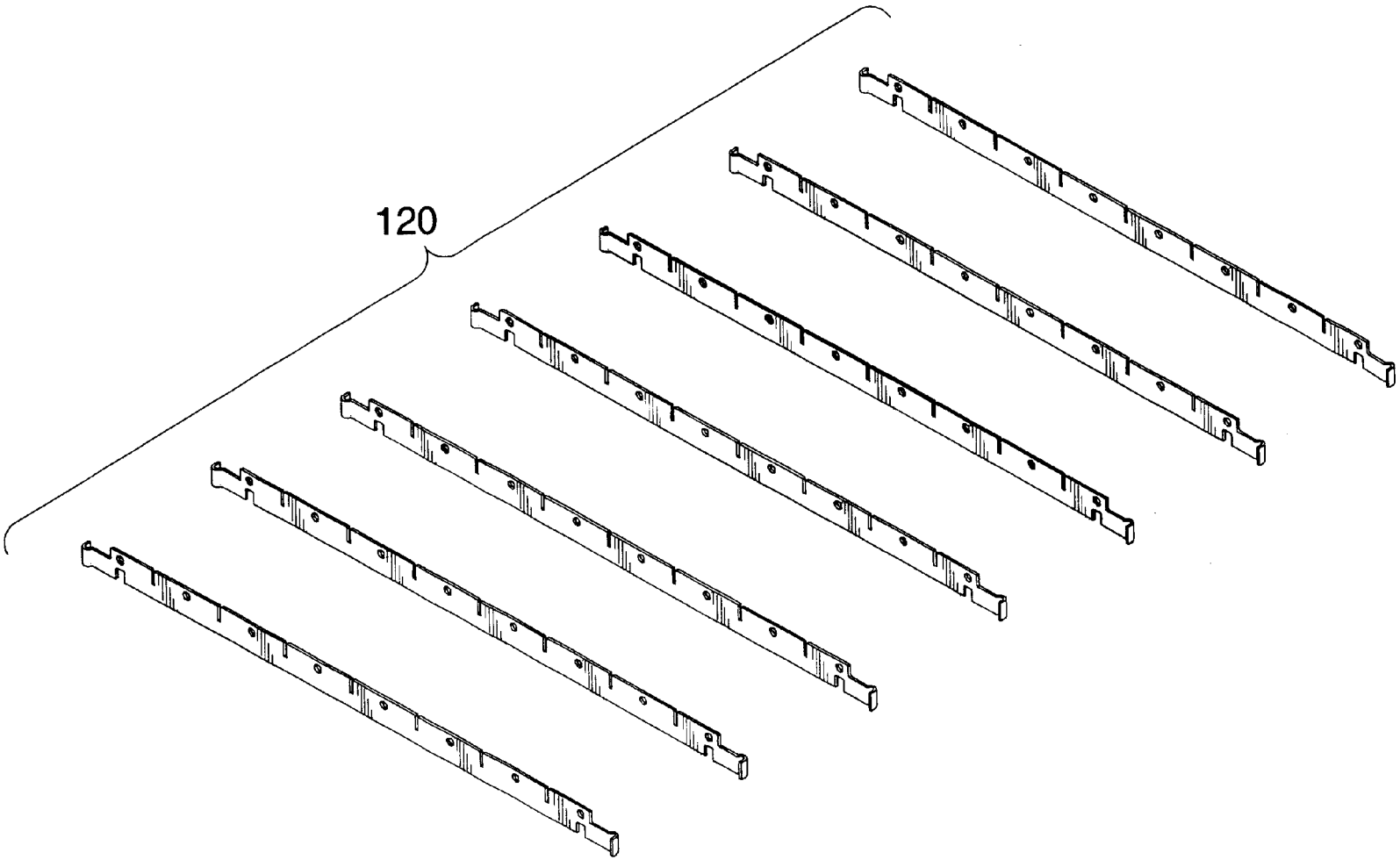
FIG. 5A is an elevational perspective side view of a first set of transverse runners laid out for step one of a step-by-step assembly of a reinforcement assembly according to the first embodiment of the invention.
Figure 5B:
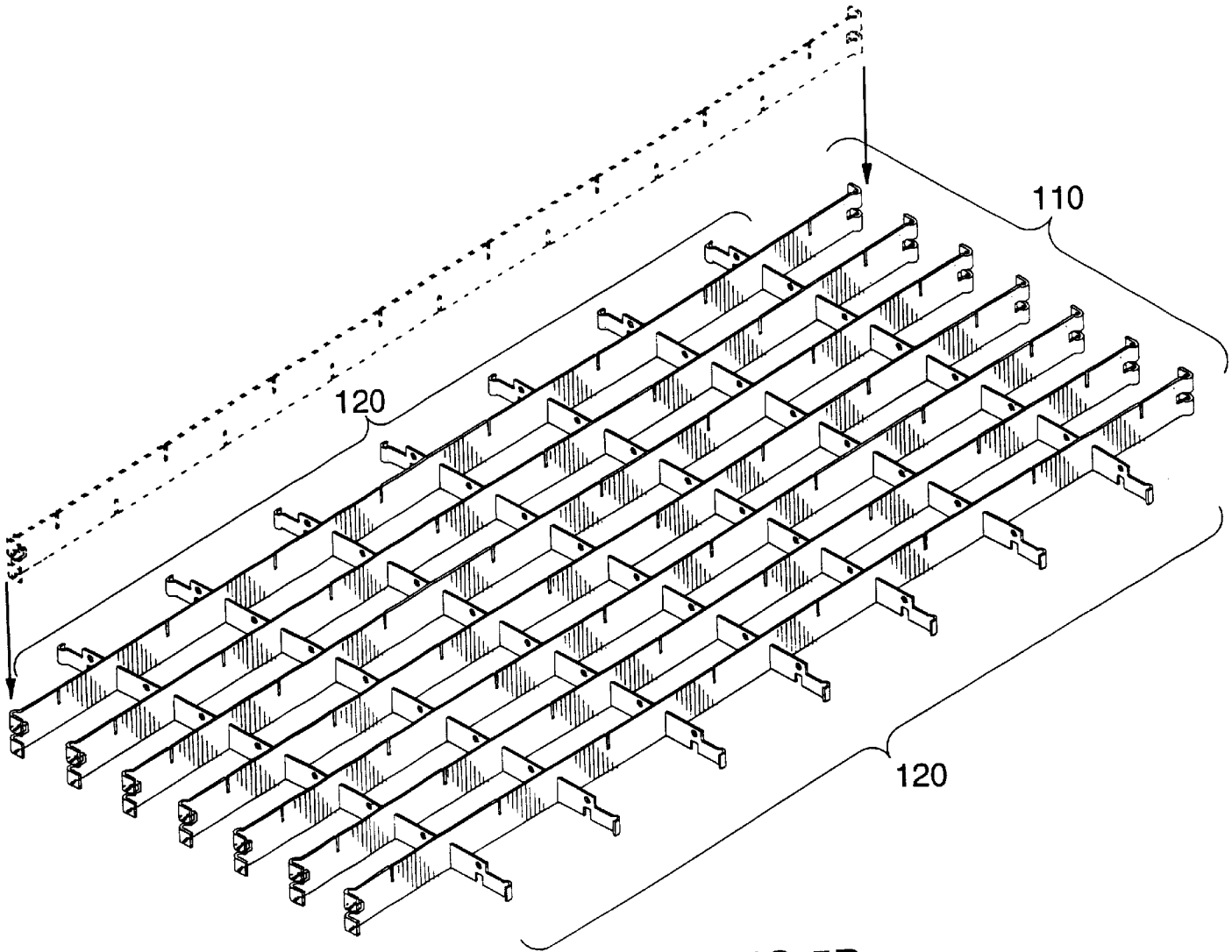
FIG. 5B is an elevational perspective side view of a set of longitudinal runners laid out on the assembly of FIG. 5A for step two of a step-by step assembly of a reinforcement assembly according to the first embodiment of invention.
Figure 5C:
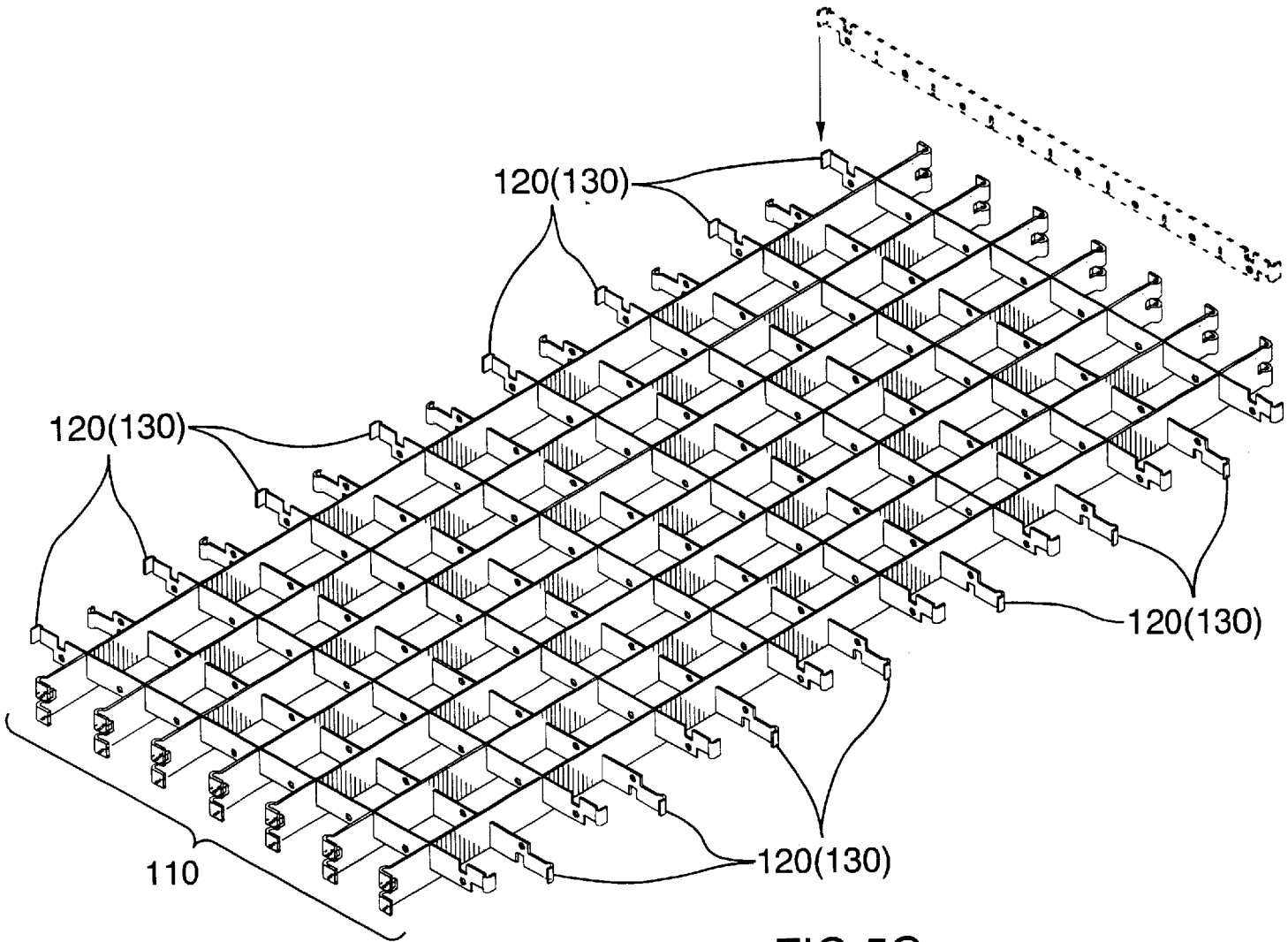
FIG. 5C is an elevational perspective side view of a second set of transverse runners laid out on the assembly of FIG. 5B for step three of a step-by-step assembly of a reinforcement assembly according to the first embodiment of invention.
Figure 5D:
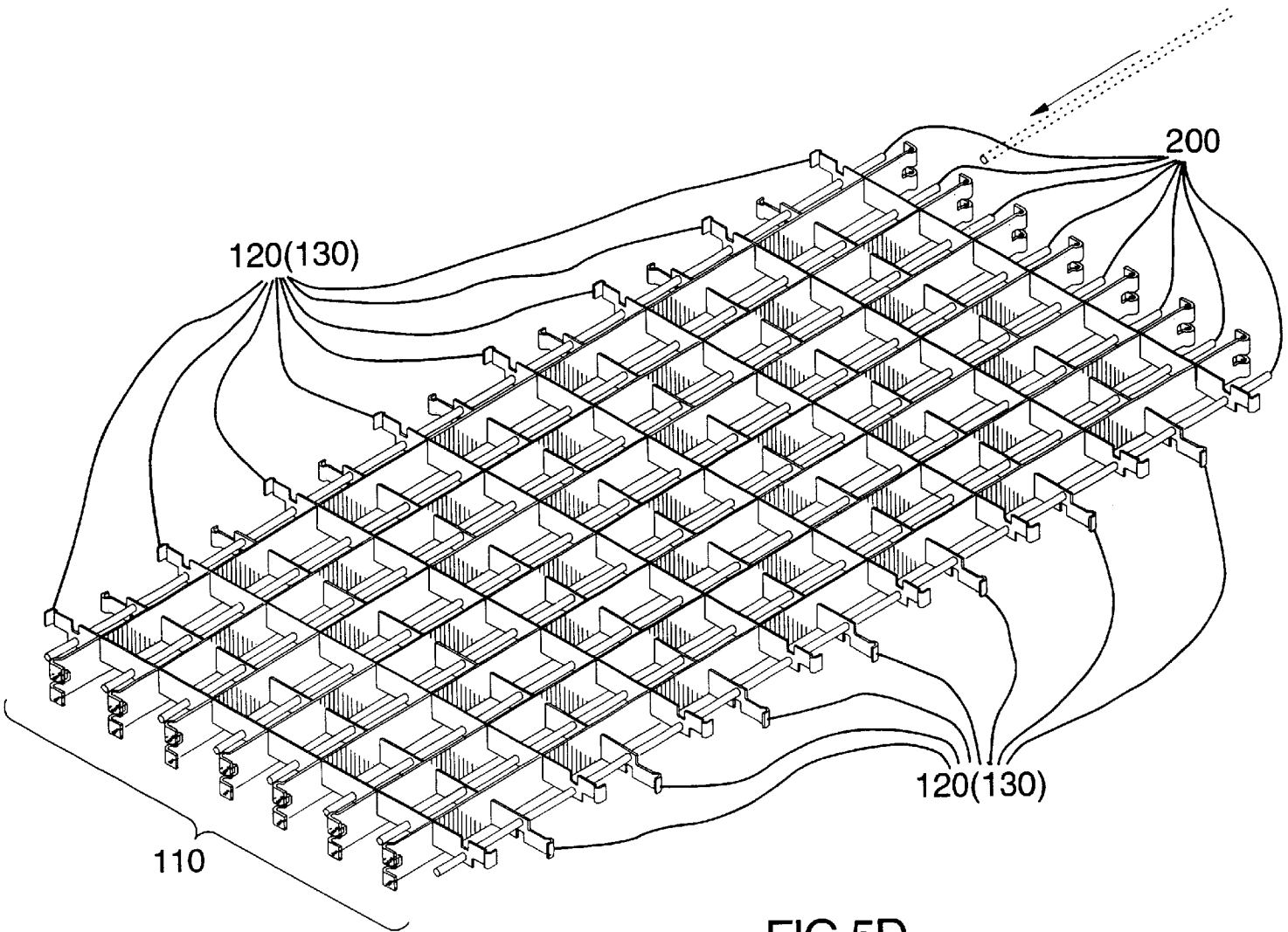
FIG. 5D is an elevational perspective side view of a set of strengthening members inserted in the assembly of FIG. 5C for step four of a step-by-step assembly of a reinforcement assembly according to the first embodiment of invention.
Figure 5E:
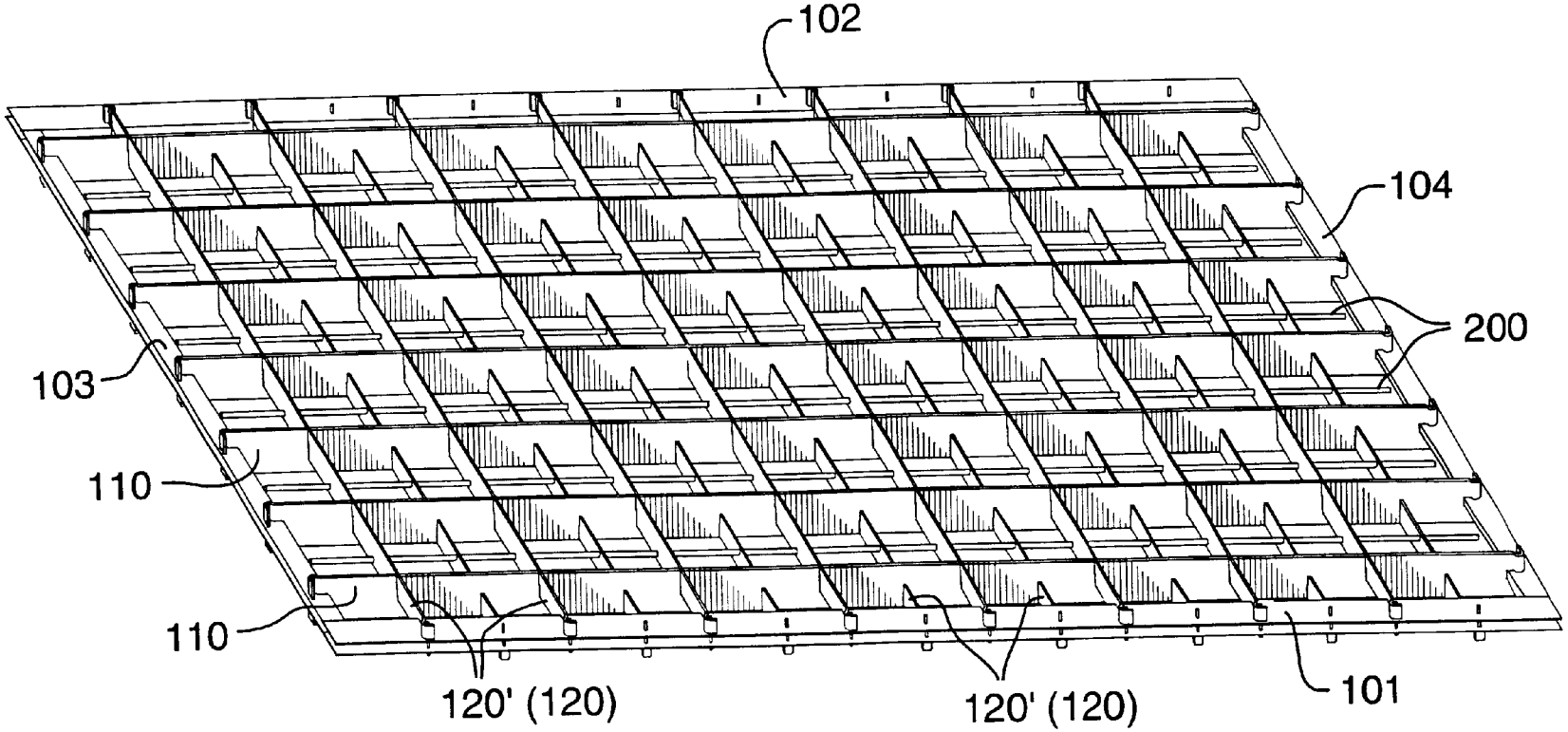
FIG. 5E is an elevational perspective side view of two longitudinal and two transverse frame parts of the frame inserted in the assembly of FIG. 5D for step five of a step-by-step assembly of a reinforcement assembly according to the first embodiment of invention.

FIGS. 5A to 5E show the different steps of assembling the reinforcement assembly 10 according to the first embodiment of the invention. A method of assembling the reinforcement assembly 10 according to the first embodiment preferably comprises the steps of:

1) placing the first set of transverse runners 120 on an even surface, as is shown in FIG. 5A,
2) placing the set of longitudinal runners 110 with the third cutouts 210 over the first set of transverse runners 120, as is shown in FIG. 5B,
3) inserting the first transversal part 103 of the frame in the second cutout 240 of the longitudinal runners so that the first frame holding means 151 grips the corresponding runner end mounting means 170 of the frame, then inserting the first longitudinal part 101 of the frame aligned with the seventh cutouts 290 at the fourth short end 122 of the first set of transverse runners 120, and inserting the second longitudinal part 102 of the frame aligned with the seventh cutouts 290 at the third short end 121 of the second set of transverse runners 120,
4) placing the second set of transverse runners 130 on top of the longitudinal runners 110 in the fourth cutouts 220 of the longitudinal runners, as is shown in FIG. 5C,
5) inserting the locking and strengthening members 200 in the eighth cutouts 280 of the transverse runners 120', as is shown in FIG. 5D,
6) inserting and fully seating the second transversal part 104 of the frame in the first cutout 230 of the longitudinal runners, without runner end mounting means 170, then installing the runner end mounting means so that the second frame holding means 152 grips the corresponding runner end mounting means 170 of the frame, as is shown in FIG. 5E. The three first frame elements (either type of transversal parts or longitudinal parts) to be assembled onto the assembly of step 4), may be assembled with the corresponding runner end mounting means 170 already inserted in the frame elements. The last frame element must be inserted with the end runner mounting means being inserted after the frame element is in place, otherwise already inserted runner end mounting means 170 would block. the frame element from insertion.

Advantageously, a jig (not shown) is used to properly align the transverse runners with respect to the longitudinal runners during assembly. Alternatively, the longitudinal runners are placed on an even surface first, then the first set of transverse runners are mounted onto the longitudinal runners. The frame parts are inserted and the assembly is then lifted and flipped so that the second set of transverse runners can be placed on the longitudinal runners.

Figure 5F:
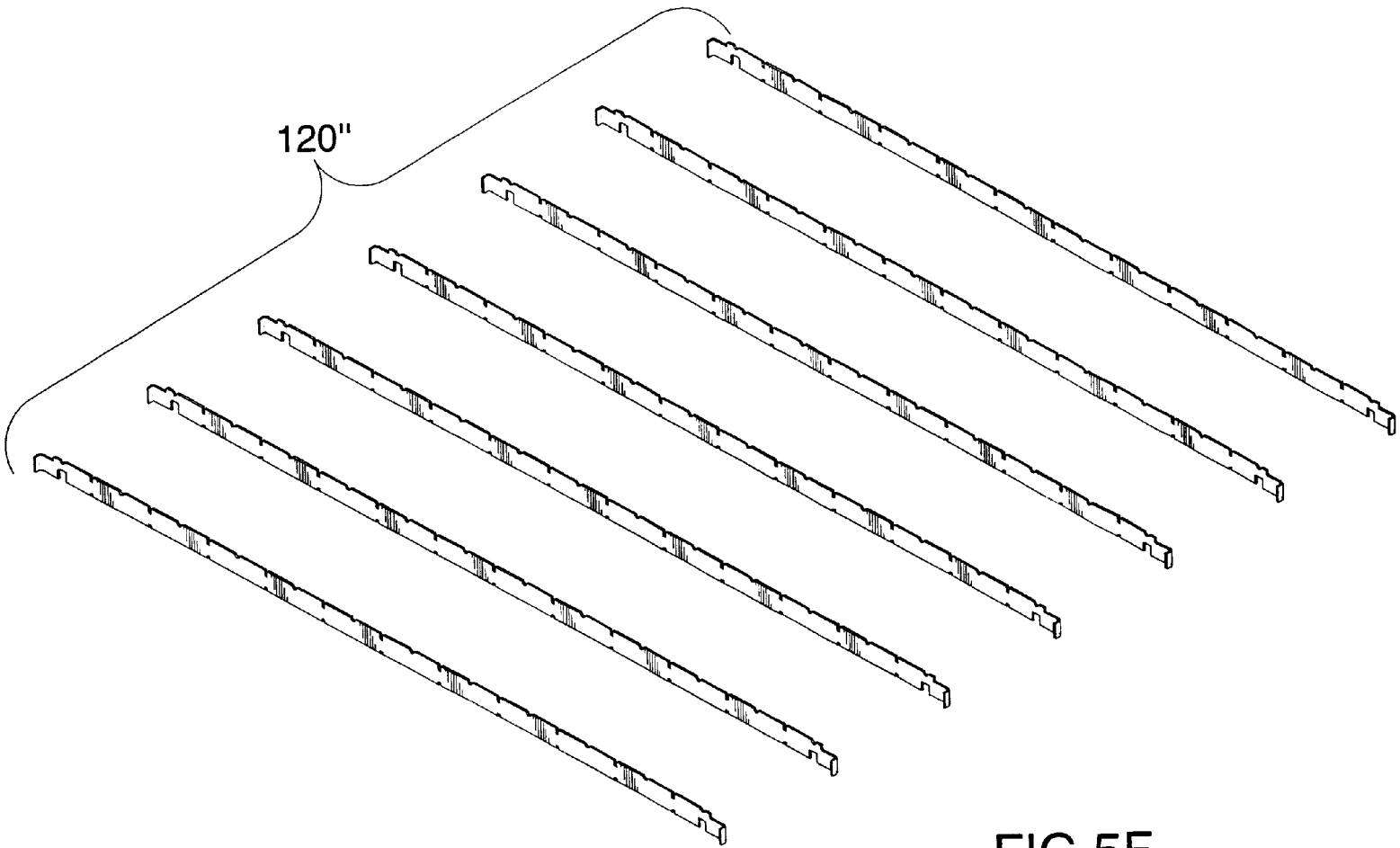
FIG. 5F is an elevational perspective side view of a set of a first set of transverse runners laid out for step one of a step-by-step assembly of a reinforcement assembly according to the second embodiment of the invention.
Figure 5G:
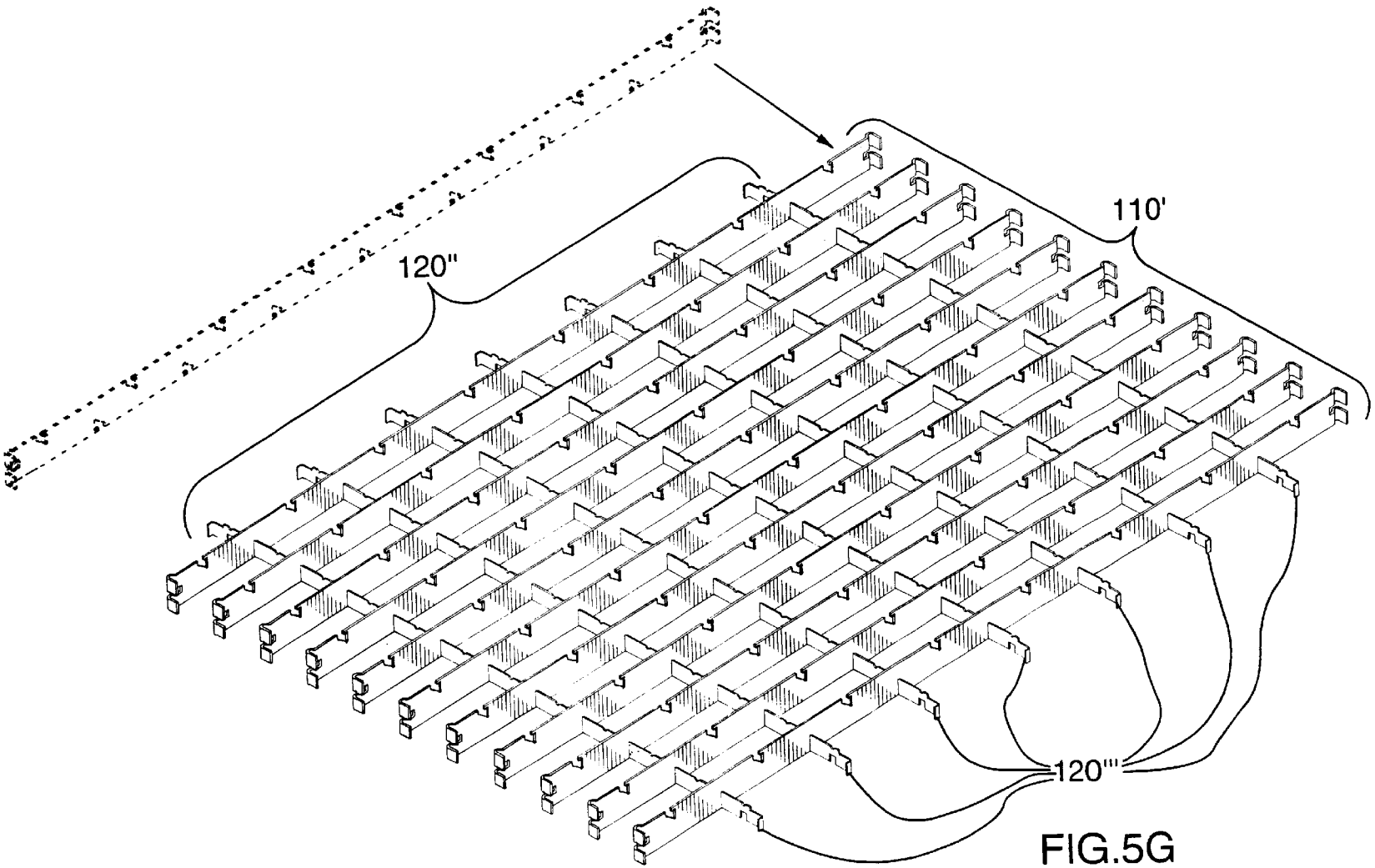
FIG. 5G is an elevational perspective side view of a set of longitudinal runners laid out on the assembly of FIG. 5F for step two of a step-by step assembly of a reinforcement assembly according to the second embodiment of invention.
Figure 5H:
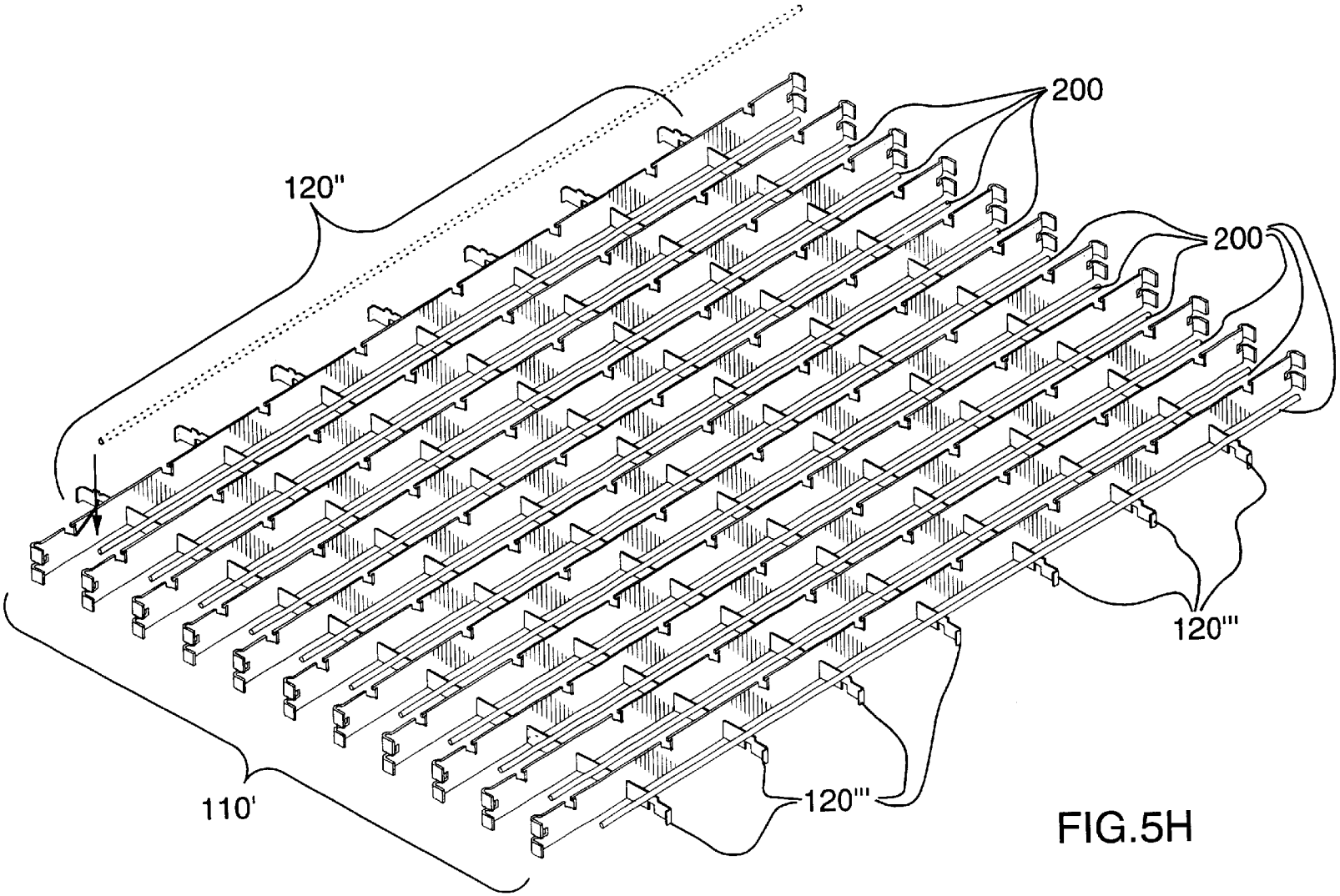
FIG. 5H is an elevational perspective side view of a set of strengthening members laid out on the assembly of FIG. 5G for step three of a step-by-step assembly of a reinforcement assembly according to the second embodiment of invention.
Figure 51:
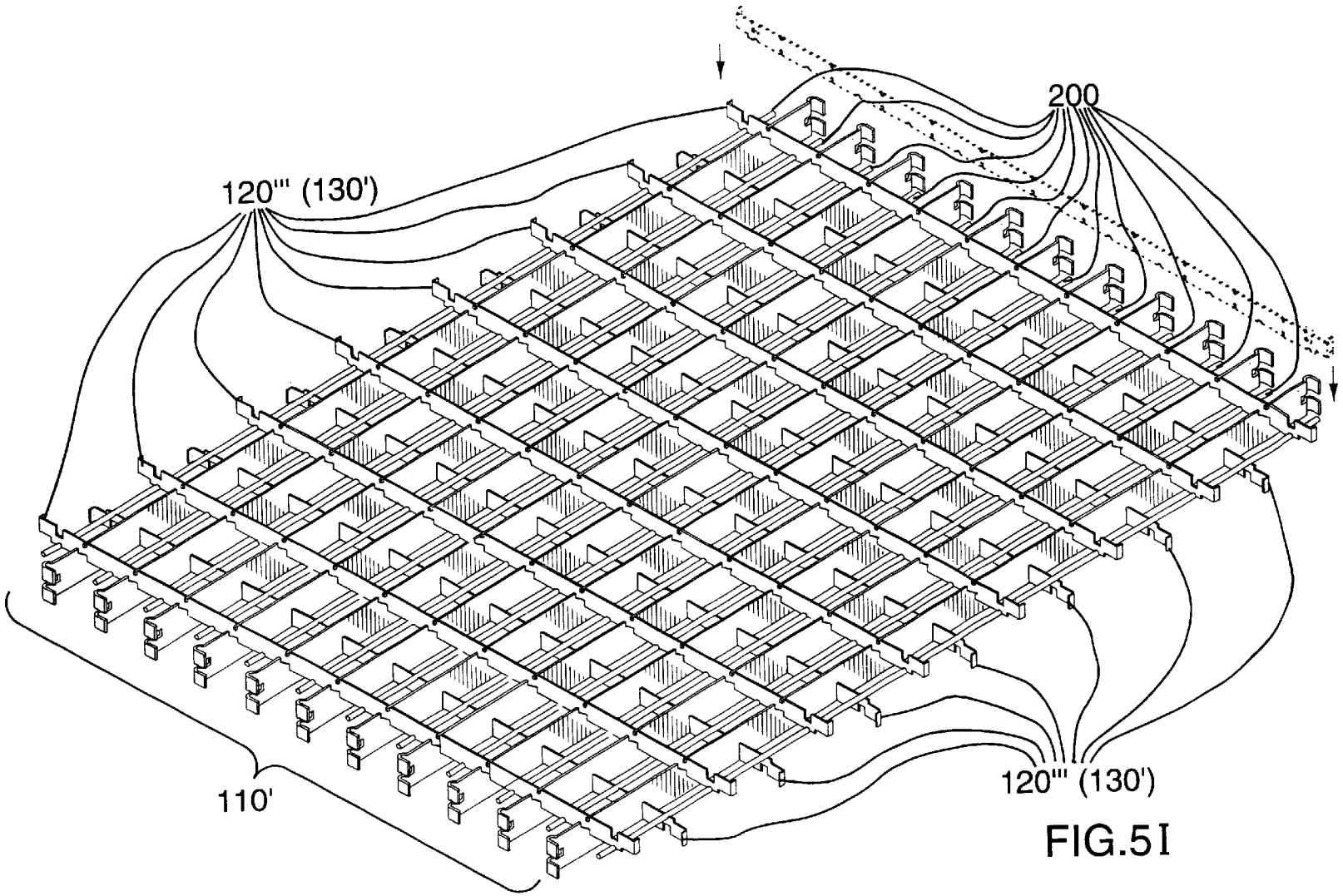
Figure 5J:
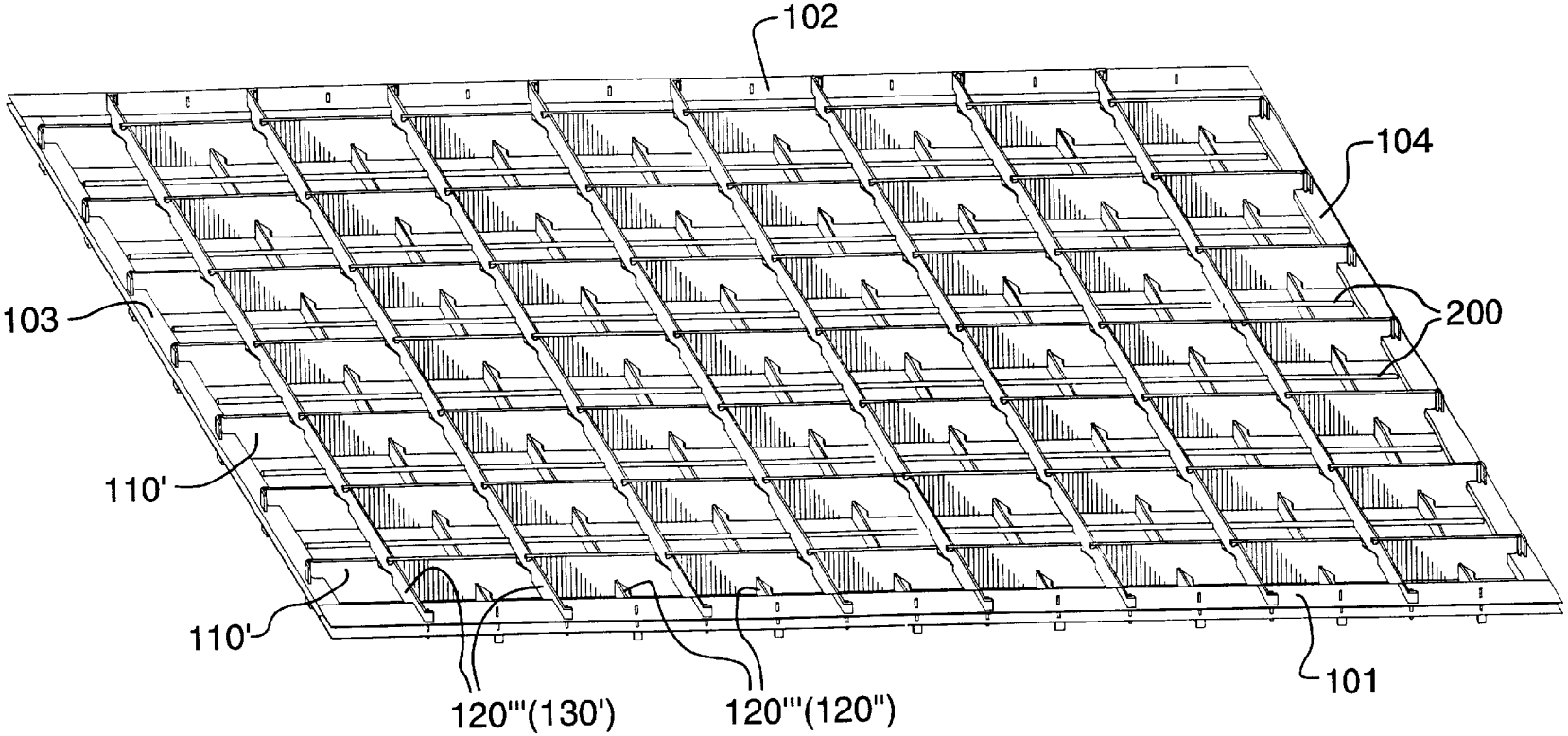
FIG. 5J is an elevational perspective side view of two longitudinal and two transverse frame parts of the frame inserted in the assembly of FIG. 5I for step five of a step-by-step assembly of a reinforcement assembly according to the second embodiment of invention.

The method of assembling the reinforcement assembly 10' according to the second embodiment preferably comprises the same steps as described above, the difference being that the locking and strengthening members 200 are placed in the eighth cutouts 280' of the transverse runners 120''' according to the second embodiment. Thus, the method of assembling the reinforcement assembly according to te second embodiment of the invention would preferably comprise the steps of:

1) placing the first set of transverse runners 120 on an even surface, as is shown in FIG. 5F,
2) placing the set of longitudinal runners 110 with the third cutouts 210 over the first set of transverse runners 120, inserting the transverse runners at an angle to a position as shown in FIG. 5G,
3) inserting the first transversal part 103 of the frame in the second cutout 240 of the longitudinal runners so that the first frame holding means 151 grips the corresponding runner end mounting means 170 of the frame,
4) inserting the second transversal part 104 of the frame in the first cutout 230 of the longitudinal runners, so that the second frame holding means 152 grips the corresponding runner end mounting means 170 of the frame,
5) inserting the first longitudinal part 101 of the frame aligned with the seventh cutouts 290 at the fourth short end 122 of the first set of transverse runners 120, and placing the second longitudinal part 102 of the frame aligned with the seventh cutouts 290 at the third short end 121 of the second set of transverse runners 120, as is shown in FIG. 5J,
6) inserting the locking and strengthening members 200 in the eighth cutouts 280 of the transverse runners 120', as is shown in FIG. 5H,
7) placing the second set of transverse runners 130 on top of the longitudinal runners 110 in the fourth cutouts 220 of the longitudinal runners, inserting the transverse runners at an angle and straightening them after insertion, to a position as shown in FIG. 5I,
8) tilting each individual runner of the first set of transverse runners 120 so that each third frame holding means 153 of each runner grips the corresponding runner end mounting means 170 of the frame, and each fourth frame holding means 154 of each runner grips the corresponding runner end mounting means 170 of the frame,
9) tilting each individual runner of the second set of transverse runners 130 so that each third frame holding means 153 of each runner grips the corresponding runner end mounting means 170 of the frame, and each fourth frame holding means 154 of each runner grips the corresponding runner end mounting means 170 of the frame.

The three first frame elements (either type of transversal parts or longitudinal parts) to be assembled onto the assembly of step 4), may be assembled with the corresponding runner end mounting means 170 already inserted in the frame elements. The last frame element must be inserted with the end runner mounting means being inserted after the frame element is in place, otherwise already inserted runner end mounting means 170 would block the frame element from insertion.

Advantageously, a jig (not shown) is used to properly align the transverse runners with respect to the longitudinal runners during assembly.

To join two reinforcement assemblies 10, either before or after casting the cement or other wall forming material, a key section 300 is used. This is shown in FIGS. 6A and 6B, describing an end-to-end joint of two reinforcement assemblies and the special key section used for the joint. In FIG. 6A, already cast building panels are shown. The key section 300 comprises a substantially flat elongate member having angled slots 310 arranged adjacent each long side of the key section. The angled slots accept runner end mounting means 170, which are described in connection with FIGS. 2A and 2C. The key section is inserted between the first leg member 140 and the second leg member 150 of the frame 100 of one of the reinforcement assemblies 10, after the runner end mounting means are inserted into the corresponding first through holes 180 and second through holes 190 of the frame part. The key section 300 is placed with its angled slots 310 aligned with the runner end mounting means 170 already inserted into the first through holes 180 and second through holes 190 of frame parts belonging to two different reinforcement assemblies 10. Subsequently, the key section is driven in the direction indicated with arrow C in FIG. 6B, for example using sledge hammers or pneumatic devices, so that the assemblies are drawn together and secured with respect to each other. The driving operation is halted when the runner end mounting means 170 are seated at the end of the angled slots 310. This is repeated as necessary on any remaining reinforcement assemblies 10, using further key sections 300, to form larger reinforced structures having secure joints with each other. The runner end mounting means 170 locked by the key sections 300, prevent the parting of adjacent reinforcement assemblies 10. Since the key section 300 has to be inserted between the first leg member 140 and the second leg member 150 of the frame 100 of one of the reinforcement assemblies 10, the described method of joining two reinforcement assemblies can only be used together with frames of the type shown in FIG. 2B if suitably located relief holes (not shown) are arranged in the sides of the frame parts.

Alternatively, the key section 300 may be inserted into the frame part of the building panel that is going to be joined to another already standing building panel. The panel with the key section is then lifted into place and lowered down next to the standing panel, so that the key section engages the runner end mounting means 170 of the standing panel.

Figure 6D:
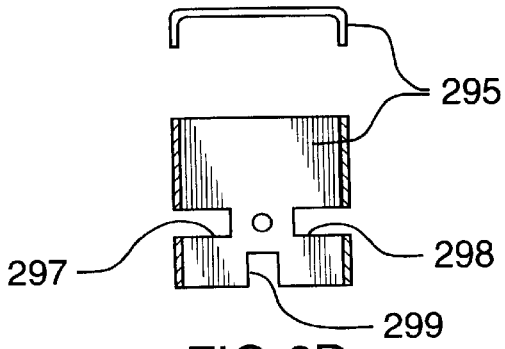
FIG. 6D is a schematic side view of a corner connector according to the invention.
Figure 6C:
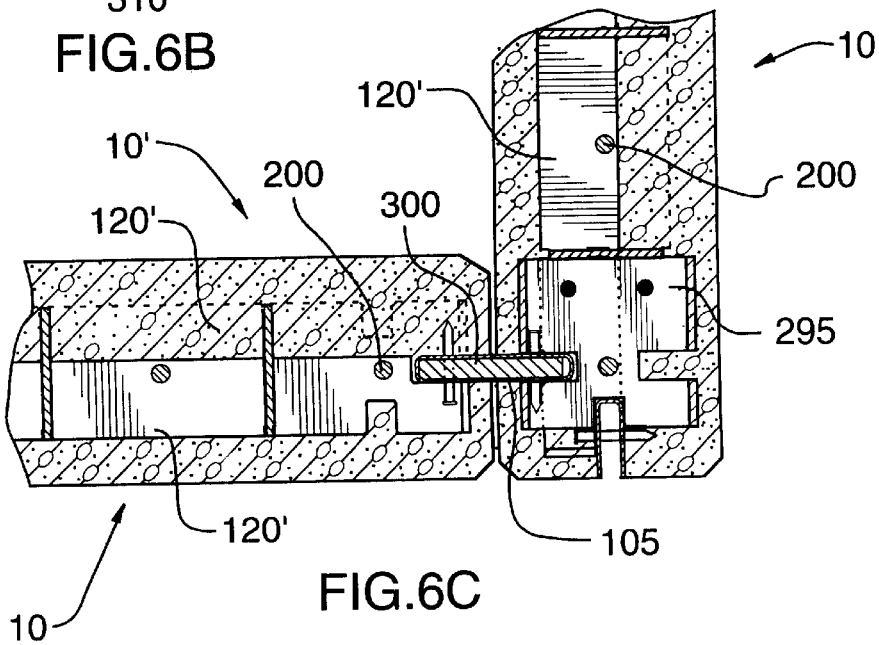
FIG. 6C is a schematic side view of a 90 degree corner joint of two reinforcement assemblies according to the first embodiment of the invention.

To establish a 90 degree corner joint between two reinforcement assemblies 10, a corner connector 295 is used (as shown in FIG. 6D). The corner connector 295 preferably has a channel-shaped cross-section, with a middle section and two flanges, where the flanges are facing out from the transverse runner 120' to which the corner connector is to be fastened. The corner connector further has a first side cutout 297, arranged in one side where a flange is present and corresponding in size and shape to the first cutout 230 and the second cutout 240 of the longitudinal runners 110. The corner connector further has a second side cutout 298, corresponding to the first side cutout 297, but arranged at the opposite side of the corner connector. A fourth through hole 296 is arranged in the corner connector 295, to allow the locking and strengthening members 200 to pass therethrough. An end cutout 299 is arranged at one flange-less end of the corner connector 295, to allow the frame part to be attached to the corresponding side of the reinforcement assembly 10. FIGS. 6C, 6F and 6G show already cast building panels being joined in a 90 degree corner joint. The corner connector 295 is fastened to a transverse runner 120' adjacent one end of the transverse runner, for example by welding, rivetting or bolting, so that either the first side cutout 297 or the second side cutout 298 is aligned with the corresponding ninth cutout 291 of the appropriate transverse runner 120'. Since there is no frame part in the direction perpendicular to either the longitudinal axis A or the transverse axis B of the assembly (as shown in FIGS. 1A and 1B), a separate channel 105 is inserted into the appropriate first side cutout 297 or second side cutout 298 of the corner connector 295. The separate channel has a cross-section corresponding to the cross-section of the frame parts used, and first through hole 180 and second through hole 190 identical to what has been described above relating to the frame parts. Channel mounting means 170' are then inserted into the first through holes and second through holes of the separate channel 105. The channel mounting means 170' are identical to the earlier described runner end mounting means 170.

The separate channel 105 is thus placed into either the first side cutout 297 or the second side cutout 298. The channel mounting means 170' in the separate channel are engaged by the flange on the corner connector 295, thereby holding the separate channel to the transverse members in the same manner as the frame members are held to the ends of the transverse members. When cast in concrete a channel remains on the perpendicular face of the cast panel. Thus, the key section can then be used to connect two finished panels into a 90 deg. corner in the same way that panels are connected end to end. Only after panels have been poured and hardened can a corner connection be made.

The two panels to be joined are aligned with each other, and the key section 300 is inserted between the first leg member 140 and the second leg member 150 of the frame 100 of one of the building panels containing a reinforcement assembly 10. The runner end mounting means 170 are thus gripping the third through holes 310 of the key section 300. Simultaneously, the remaining free end of the key section is inserted into the appropriate first side cutout 297 or second side cutout 298 of the corner connector 295, and the remaining free third through holes 310 of the key section 300 will grip the channel mounting means 170' mounted in the separate channel 105. All three holes are aligned as previously described, and the runner end mounting means 170 is then fastened. The flange of the corner connector 295 thus prevents the key section 300 from being removed from between the frame leg members. Also here, the above remark regarding the frame shown in FIG. 2B is relevant, the described method of joining two reinforcement assemblies can only be used together with frames of the type shown in FIG. 2B if suitably located relief holes (not shown) are arranged in the sides of the frame parts.

Alternatively, the key section 300 may be inserted into the frame part of the building panel that is going to be joined to another already standing building panel. The panel with the key section is then lifted into place and lowered down next to the standing panel, so that the key section engages the channel mounting means 170' of the standing panel. Other alternative steps of performing the corner joining of building panels according to the invention should be clear to the person skilled in the art having knowledge of the here described invention.

Figure 6E:
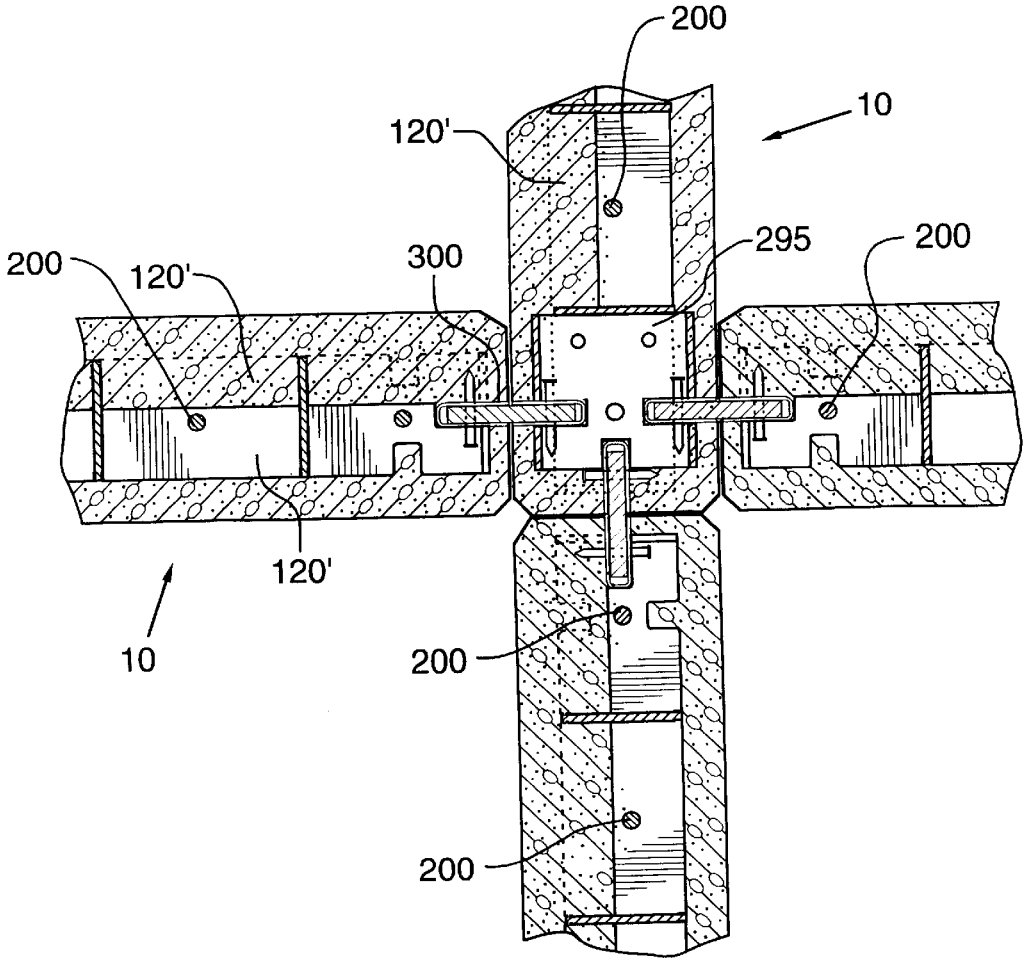
FIG. 6E is a schematic side view of a full joint of four reinforcement assemblies according to the first embodiment of the invention.
Figure 6F:
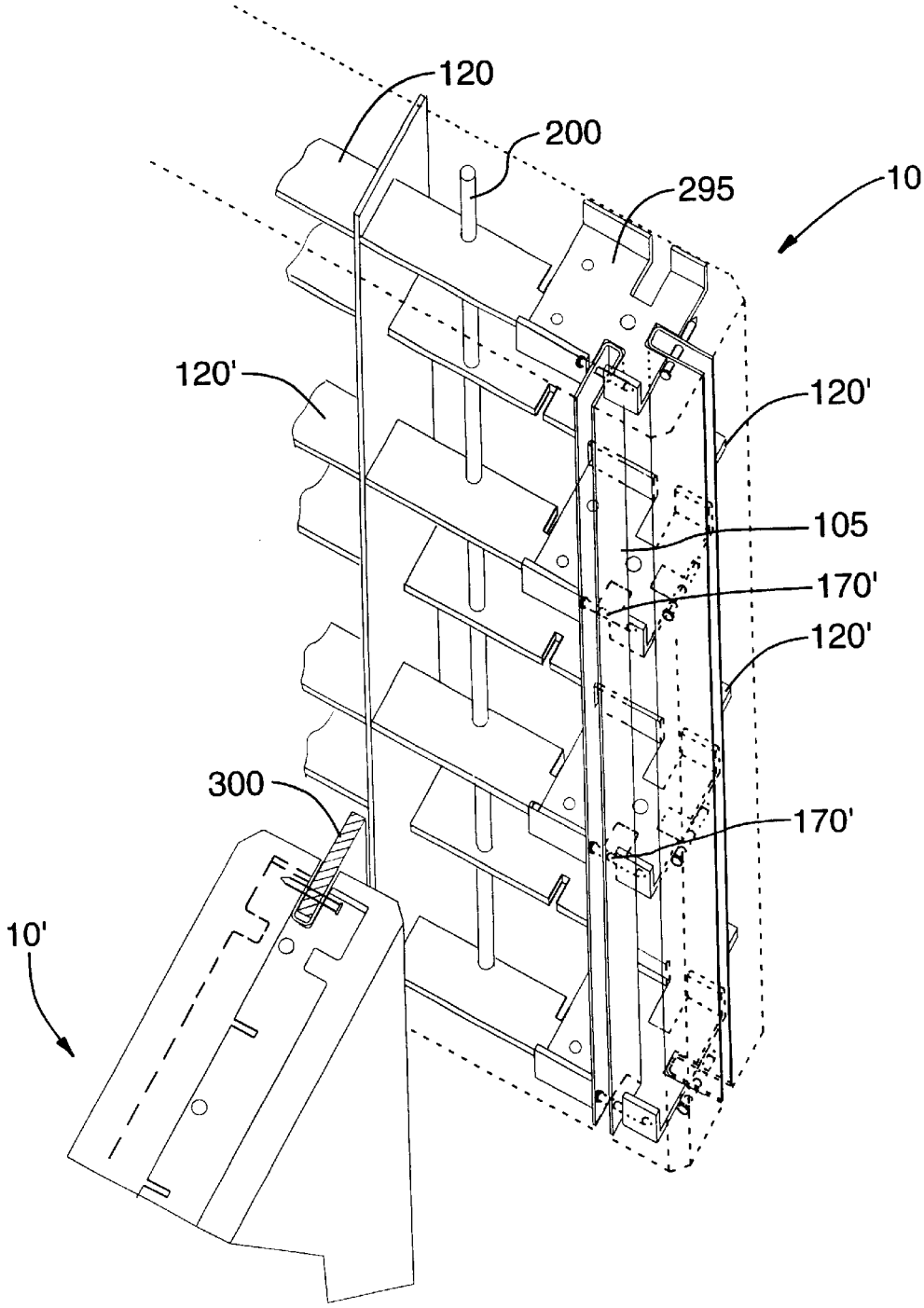
FIG. 6F is a schematic perspective view of an reinforcement assembly according tc, the second embodiment of the invention, prepared for making a corner joint with another reinforcement assembly.
Figure 6G:
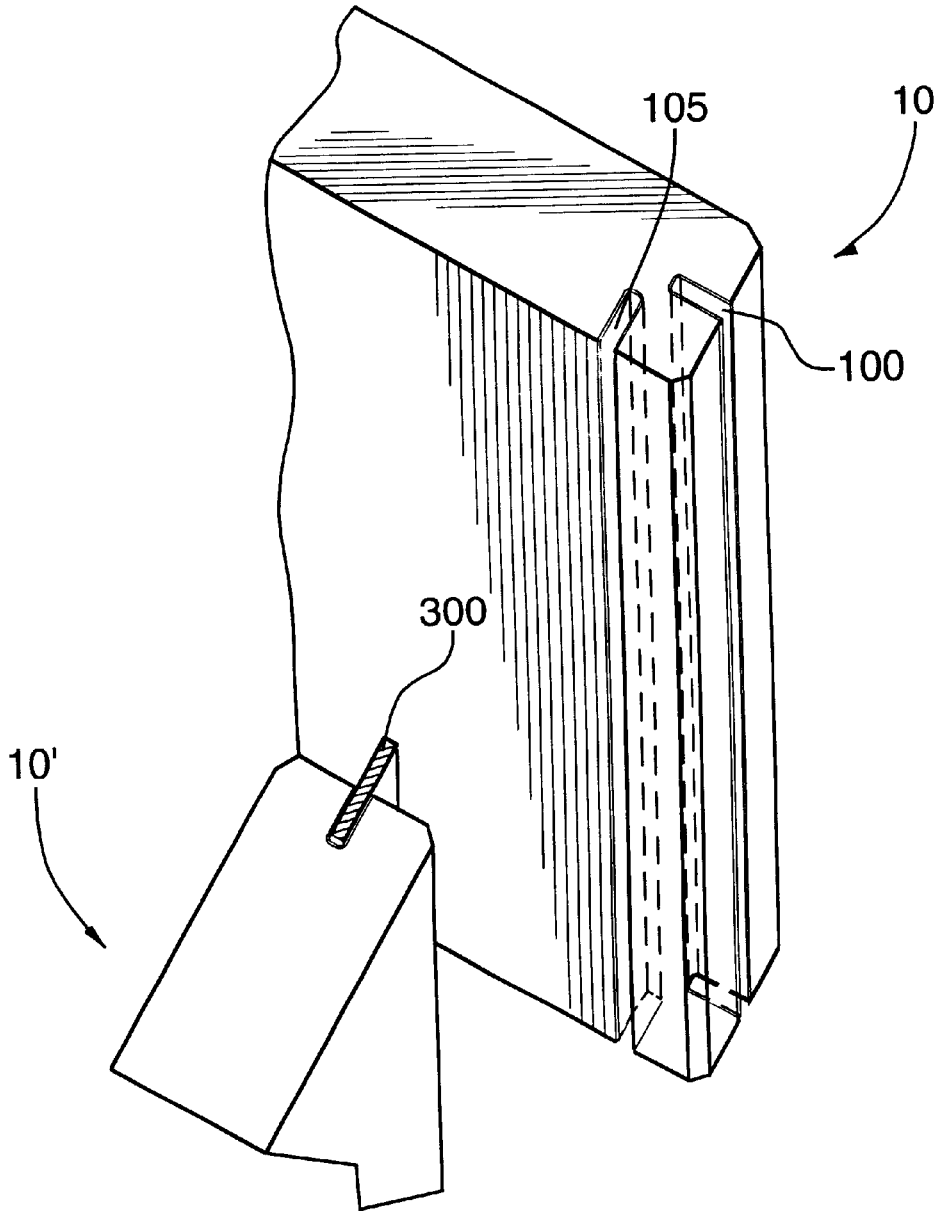
FIG. 6G is a schematic perspective view of the reinforcement assembly according to FIG. 6F.

A combination of end-to-end joint and 90 degree joint is shown in FIG. 6E, where four already cast buildings panels containing reinforcement assemblies 10 are joined. The combination consists of one end-to-end joint, as described in relation to FIG. 6A above, and two 90 degree joints, as described in relation to FIG. 6C above. All reference numerals are identical to these Figs.

An advantage with a reinforcing assembly according to the invention, is that the reinforcing assembly may be assembled in one location and then lifted to the location of the actual cement casting mould, without breaking up and falling apart. Several of the reinforcement assemblies may be interconnected, either before or after casting, to form larger barrier systems, such as walls or floors/ceilings of a building.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, the stated use has been to utilize the reinforcement assembly in concrete castings, but other types of casting materials may be used.

What is claimed as the invention is:

1. A reinforcement assembly for concrete castings, where the assembly is substantially
rectangular having a longitudinal axis and a transverse axis, the assembly comprising a frame, a first set of longitudinal runners, a second set of transverse runners, and a third set of transverse runners, where each individual runner has two short ends and each short end has a frame holding means, and where the runners are arranged in a hatch pattern where the longitudinal runners are arranged substantially perpendicular to the transverse runners, wherein the frame comprises a first leg member, a second leg member, and a shoulder member, where the first leg member has a plurality of first through holes and the second leg member has a corresponding number of second through holes which are substantially concentric with the corresponding first through holes, and where runner end mounting means are arranged in a pair of corresponding first and second through holes of the first and second leg members, respectively, and
where the frame holding means of each short end of a runner is arranged to engage with an individual runner end mounting means of the frame.

2. A reinforcement assembly for concrete castings according to claim 1, wherein the runner end mounting means are substantially cylindrical rods, and the frame holding means are hook-shaped, so that each frame holding means is engageable around at least part of the circumference of the runner end mounting means.

3. A reinforcement assembly for concrete castings according to claim 2, wherein the frame comprises four separate parts, a first longitudinal part and a second longitudinal part together with a first transversal part and a second transversal part.

4. A reinforcement assembly for concrete castings according to claim 3, further comprising strengthening members which are longitudinally arranged between the first and second sets of transverse runners to further strengthen the assembly.

5. A reinforcement assembly for concrete castings according to claim 4, wherein the transverse runners have eighth cutouts for accommodating the strengthening members, and the strengthening members comprise bars having a cross-sectional shape corresponding to the shape of the eighth cutouts in the transverse runners.

6. A reinforcement assembly for concrete castings according to claim 5, wherein the longitudinal runners comprise a first end having a first frame holding means and a first cutout for accommodating at least a part of the frame, a second end having a second frame holding means and a second cutout for accommodating at least a part of the frame, third cutouts arranged along a first long side of the longitudinal runners for accommodating the first set of transversal runners, and fourth cutouts arranged along a second long side of the longitudinal runners for accommodating the second set of transversal runners.

7. A reinforcement assembly for concrete castings according to claim 6, wherein the transversal runners comprise a third end having a third frame holding means, a fourth end having a fourth frame holding means, fifth cutouts arranged along a first long end of the transversal runner, to cooperate with either the third cutouts or the fourth cutouts of the longitudinal runner, and seventh cutouts arranged one at the third end and one at the fourth end, for accommodating at least part of the frame.

8. A reinforcement assembly for concrete castings according to claim 6, wherein the transversal runners comprise a third end having a third frame holding means, a fourth end having a fourth frame holding means, fifth cutouts arranged along a first long end of the transversal runner, to cooperate with either the third cutouts or the fourth cutouts of the longitudinal runner, sixth cutouts arranged along a second long end of the transversal runner, to cooperate with either the third cutouts or the fourth cutouts of the longitudinal runner, and seventh cutouts arranged one at the third end and one at the fourth end, for accommodating at least part of the frame.

9. A reinforcement assembly for concrete castings according to claim 1, wherein the first leg member, the second leg member and the shoulder member are arranged in a substantially U-shaped cross-section.

10. A reinforcement assembly for concrete castings according to claim 1, wherein the first leg member, the second leg member and the shoulder member are arranged in a substantially H-shaped cross-section.

11. A reinforcement assembly for concrete castings according to claim 1, wherein the first leg member, the second leg member, the shoulder member and a closure member are arranged in a substantially closed cross-section, i.e. forming a substantially rectangular cross-section.

12. A grouping of two reinforcement assemblies according to claim 1, wherein the two reinforcement assemblies are joined end-to-end by a key section, which comprises a substantially flat elongate member having a plurality of angled slots arranged in pairs one slot of the pair arranged on each long side of the key section,
the angled slots accept the runner end mounting means when the key section is inserted between the first leg member and the second leg member of the frame of one of the reinforcement assemblies, after the runner end mounting means are inserted into the corresponding first through holes and second through holes of the frame part.

13. A grouping of two or more reinforcement assemblies according to claim 1, wherein the two or more reinforcement assemblies are joined in a substantially 90 degree joint by a key section and a corner connector fastened to the transverse runners adjacent one end of the transverse runners, the key section comprising a substantially flat elongate member having a plurality of angled slots arranged in pairs one slot of the pair arranged on each long side of the key section, and the corner connector comprising a channel-shaped cross-section, with a middle section and two flanges, where the flanges are facing out from the transverse runner to which the corner connector is fastened, a first side cutout, arranged in one flanged side of the corner connector, a second side cutout, corresponding to the first side cutout in shape but which is arranged at the opposite side of the corner connector, and wherein a separate channel is inserted into the appropriate side cutout of the corner connector, the separate channel having a cross-section corresponding to the cross-section of the frame, and a plurality of first and second through holes corresponding to the first and second holes of the frame, the separate channel further having channel mounting means inserted into the first and second holes of the separate channel, so that the angled slots on one side of the key section accept the runner end mounting means when the key section is inserted between the first leg member and the second leg member of the frame of one of the reinforcement assemblies, after the runner end mounting means are inserted into the corresponding first through holes and second through holes of the frame part, and, simultaneously, the channel mounting means of the separate channel accept the angled slots arranged on the opposite side of the key section during the insertion of the key section.

14. A concrete structure utilizing a reinforcement assembly according to claim 1.

15. A concrete structure utilizing a grouping of reinforcement assemblies according to claim 12.

16. A concrete structure utilizing a grouping of reinforcement assemblies according to claim 13.

17. A method of grouping two reinforcement assemblies according to claim 1, wherein the two reinforcement assemblies are joined end-to-end by a key section, which comprises a substantially flat elongate member having angled slots arranged adjacent each long side of the key section to accept runner end mounting means, the method comprising the steps of:

a) aligning two reinforcement assemblies end-to-end with each other, b) inserting runner end mounting means into the first through holes and second through holes of frame parts belonging to two different reinforcement assemblies, c) placing the key section with its angled slots aligned with the runner end mounting means, d) driving the key section so that the assemblies are drawn together and secured with respect to each other, e) halting the driving operation when the runner end mounting means are seated at the end of the angled slots.

18. A method of grouping two or more reinforcement assemblies according to claim 1, wherein the two or more reinforcement assemblies are joined in a substantially 90 degree joint by a key section and a corner connector fastened to the transverse runners adjacent one end of the transverse runners, the key section comprising a substantially flat elongate member having a plurality of angled slots arranged in pairs one slot of the pair arranged on each long side of the key section, and the corner connector comprising a channel-shaped cross-section, with a middle section and two flanges, where the flanges are facing out from the transverse runner to which the corner connector is fastened, a first side cutout, arranged in one flanged side of the corner connector, a second side cutout, corresponding to the first side cutout in shape but which is arranged at the opposite side of the corner connector, the method comprising the steps of:

a) inserting the separate channel into the appropriate side cutout of the corner connector, the separate channel having a cross-section corresponding to the cross-section of the frame, and a plurality of first and second through holes corresponding to the first and second holes of the frame, the separate channel further having channel mounting means inserted into the first and second holes of the separate channel, b) inserting the runner end mounting means into the corresponding first through holes and second through holes of the frame part, c) inserting the key section between the first leg member and the second leg member of the frame of one of the reinforcement assemblies and into the separate channel, so that the angled slots on one side of the key section accept the runner end mounting means, and, simultaneously, the channel mounting means of the separate channel accept the angled slots arranged on the opposite side of the key section during the insertion of the key section.

19. A method of assembling the reinforcement assembly according to claim 6, the method comprising the steps of:

a) placing the first set of transverse runners on an even surface, b) placing the set of longitudinal runners with the third cutouts over the first set of transverse runners, c) placing the second set of transverse runners on top of the longitudinal runners in the fourth cutouts of the longitudinal runners, d) inserting the locking and strengthening members in the eighth cutouts of the transverse runners, e) inserting the first transversal part of the frame in the second cutout of the longitudinal runners so that the first frame holding means grips the corresponding runner end mounting means of the frame, inserting the second transversal part of the frame in the first cutout of the longitudinal runners, so that the second frame holding means grips the corresponding runner end mounting means of the frame, inserting the first longitudinal part of the frame aligned with the seventh cutouts at the fourth short end of the first set of transverse runners, and inserting the second longitudinal part of the frame aligned with the seventh cutouts at the third short end of the second set of transverse runners.

20. A method of assembling the reinforcement assembly according to claim 7, the method comprising the steps of:

a) placing the first set of transverse runners on an even surface, b) placing the set of longitudinal runners with the third cutouts over the first set of transverse runners, inserting the transverse runners at an angle and straightening them after insertion, c) inserting the locking and strengthening members in the eighth cutouts of the transverse runners, d) placing the second set of transverse runners on top of the longitudinal runners in the fourth cutouts of the longitudinal runners, inserting the transverse runners at an angle and straightening them after insertion, e) inserting the first transversal part of the frame in the second cutout of the longitudinal runners so that the first frame holding means grips the corresponding runner end mounting means of the frame, inserting the second transversal part of the frame in the first cutout of the longitudinal runners, so that the second frame holding means grips the corresponding runner end mounting means of the frame, inserting the first longitudinal part of the frame aligned with the seventh cutouts at the fourth short end of the first set of transverse runners, and placing the second longitudinal part of the frame aligned with the seventh cutouts at the third short end of the second set of transverse runners.

* * * * *